US009839956B2

(12) United States Patent
Sindlinger

(10) Patent No.: US 9,839,956 B2
(45) Date of Patent: Dec. 12, 2017

(54) FEED ASSEMBLY FOR A RIVETING MACHINE AND A METHOD OF OPERATION OF THE SAME

(71) Applicant: Weaver Leather, LLC, Mt. Hope, OH (US)

(72) Inventor: Steven K. Sindlinger, Apple Creek, OH (US)

(73) Assignee: Weaver Leather, LLC, Mt. Hope, OH (US)

( * ) Notice: Subject to any disclaimer, the term of this patent is extended or adjusted under 35 U.S.C. 154(b) by 381 days.

(21) Appl. No.: 14/282,591

(22) Filed: May 20, 2014

(65) Prior Publication Data

US 2015/0336161 A1 Nov. 26, 2015

(51) Int. Cl.

| | |
|---|---|
| ***B21J 15/00*** | (2006.01) |
| ***B23P 11/00*** | (2006.01) |
| ***B23Q 7/10*** | (2006.01) |
| ***B21J 15/32*** | (2006.01) |
| ***B21J 15/16*** | (2006.01) |
| ***B21J 15/04*** | (2006.01) |
| *B21J 15/02* | (2006.01) |
| *B23P 17/00* | (2006.01) |

(52) U.S. Cl.

CPC ..... *B21J 15/32* (2013.01); *B21J 15/04* (2013.01); *B21J 15/046* (2013.01); *B21J 15/16* (2013.01); *Y10T 29/49957* (2015.01); *Y10T 29/5377* (2015.01)

(58) Field of Classification Search

CPC ... B21J 15/00; B21J 15/02; B21J 15/04; B21J 15/06; B21J 15/08; B21J 15/10; B21J 15/16; B21J 15/105; B21J 15/36; B21J 15/38; B21J 15/14; B21J 15/32; B21J 15/323; B21J 15/383; B21J 15/46; Y10T 29/49947; Y10T 29/49956; Y10T 29/49957; Y10T 29/5118; Y10T 29/53496; Y10T 29/53522; Y10T 29/5377; Y10T 29/53774; Y10T 29/53778; Y10T 29/53783; Y10T 29/53787; Y10T 29/53791; B29C 65/60; F16B 37/062; F16B 5/04; A01G 17/085; B25B 27/146; B21D 39/046

USPC .... 29/34 B, 243.53–243.58, 525.01, 525.06, 29/812.5, 818

See application file for complete search history.

(56) References Cited

U.S. PATENT DOCUMENTS

| | | | |
|---|---|---|---|
| 1,947,680 | A | 2/1934 | Stimpson |
| 1,997,438 | A | 4/1935 | Stimpson et al. |
| 2,153,890 | A | 4/1939 | Honig |
| 2,429,387 | A | 10/1947 | Buchheim |

(Continued)

*Primary Examiner* — Sarang Afzali
*Assistant Examiner* — Darrell C Ford
(74) *Attorney, Agent, or Firm* — Sand & Sebolt

(57) ABSTRACT

A feed assembly for a foot-pedal operated riveter and a method of using the same is disclosed. The feed assembly includes a rivet stop that has a tip that separates a lowermost fastener from a second from lowermost fastener when the riveter is in a non-operational position. This rivet stop prevents fasteners from sliding down a raceway on the feed assembly. When the riveter is moved into an operational position, the rivet stop moves out of the way and permits the second from lowermost fastener to slide into position for subsequent installation. The rivet stop thus enables automatic reloading of the riveter during operation.

28 Claims, 23 Drawing Sheets

(56) References Cited

U.S. PATENT DOCUMENTS

| | | | | | |
|---|---|---|---|---|---|
| D155,154 | S | | 9/1949 | Halvorsen | |
| 3,023,412 | A | * | 3/1962 | Watkins | B27F 7/02 227/152 |
| 3,043,168 | A | | 7/1962 | May et al. | |
| D233,911 | S | | 12/1974 | Marsh | |
| D238,702 | S | | 2/1976 | Rawson | |
| D238,703 | S | * | 2/1976 | Rawson | D15/122 |
| 4,044,462 | A | | 8/1977 | Anselmo | |
| D273,121 | S | | 3/1984 | Rawson | |
| 4,578,846 | A | | 4/1986 | Schott et al. | |
| 4,615,475 | A | * | 10/1986 | Fuhrmeister | B21J 15/025 227/136 |
| 4,685,604 | A | * | 8/1987 | Falzoni | B23Q 37/00 227/120 |
| 5,005,752 | A | | 4/1991 | Obst | |
| 5,339,984 | A | * | 8/1994 | Schmidt | A41H 37/00 221/124 |
| 5,392,954 | A | | 2/1995 | Gartz | |
| D359,967 | S | | 7/1995 | Eichenberg et al. | |
| 5,465,868 | A | * | 11/1995 | Bonomi | B23P 19/001 221/156 |
| D397,123 | S | | 8/1998 | Hardy | |
| 5,813,114 | A | | 9/1998 | Blacket et al. | |
| 5,957,362 | A | * | 9/1999 | Samulowitz | A41H 37/00 227/2 |
| 6,944,944 | B1 | * | 9/2005 | Craythorn | B21J 15/32 29/243.53 |
| D599,382 | S | | 9/2009 | Tsai | |
| D599,383 | S | | 9/2009 | Tsai | |
| 7,726,554 | B2 | | 6/2010 | Thielges et al. | |
| 8,887,364 | B2 | * | 11/2014 | Kikuchi | B21J 15/14 227/112 |
| 9,120,141 | B2 | * | 9/2015 | Clew | B21J 15/323 |
| 9,149,864 | B2 | * | 10/2015 | Kikuchi | B21J 15/14 |
| 2005/0115040 | A1 | * | 6/2005 | Ohuchi | B21J 15/043 29/243.523 |
| 2009/0127279 | A1 | * | 5/2009 | Zieve | B21J 15/32 221/267 |
| 2012/0210550 | A1 | * | 8/2012 | Swinford | B21J 15/02 29/243.525 |
| 2013/0288743 | A1 | | 10/2013 | Hunt et al. | |
| 2015/0336162 | A1 | * | 11/2015 | Sindlinger | B21J 15/32 29/525.06 |
| 2016/0332217 | A1 | * | 11/2016 | Ahlemeyer | B21J 15/025 |
| 2017/0106432 | A1 | * | 4/2017 | Clew | B21J 15/28 |

* cited by examiner

FEED ASSEMBLY FOR A RIVETING MACHINE AND A METHOD OF OPERATION OF THE SAME

BACKGROUND OF THE INVENTION

Technical Field

This invention relates generally to riveters. More particularly the invention is directed to a foot operated riveter. Specifically, the invention relates to a foot operated riveter and a method of using the same, where the riveter includes an enclosed linkage assembly, a detachable feed assembly, and rivet stop on the feed assembly which automatically feeds one rivet at a time to a location where the rivet may be deployed to secure two or more workpieces together.

Background Information

Riveters, including foot-operated riveters are known in the art. Typically, these machines include a linkage assembly which transfers motion from a foot pedal to a plunger which drives a rivet into workpieces that are to be secured together. The linkage assembly includes two or more linkage arms which pivot relative to each other when the foot pedal is depressed or when pressure on the foot pedal is released. When the foot pedal is depressed, the pivoting linkage arms project for a distance outwardly beyond a back region of the riveter. This makes it necessary for the machine to be positioned a distance away from walls or workbenches, for example, so that there is sufficient room for the movement of the linkage arms.

Additionally, presently known riveters typically include some type of feed mechanism that delivers rivets to a location where they are used to secure work pieces together. Only one rivet can be installed at a time and it is typically necessary for the operator to depress a button to move a rivet from a feed assembly to the appropriate location for deployment. The depression of the button requires the operator to take extra time and make a number of additional movements whenever a set of workpieces are joined together. Since the riveter will be used to secure a plurality of sets of workpieces together, the additional time and movements required for moving single rivets into position adds up, and increases the fabrication time and costs involved.

SUMMARY

There is therefore a need in the art for an improved riveter that addresses some of these issues.

The riveter disclosed herein includes a linkage assembly that is completely enclosed within the device. The riveter includes a base and a head which are connected together by a vertical post. The foot pedal extends outwardly from the post and is operatively engaged with a part of the linkage assembly that is entirely enclosed within the interior cavity of the post. The rest of the linkage assembly is enclosed in a cavity in the head of the riveter. Consequently, the riveter disclosed herein has the advantage that it may be positioned adjacent a wall or workbench or other structure. When the riveter is used, the lever arms of the linkage assembly pivot entirely within the post or head of the riveter and thus do not contact any surrounding structures. This configuration makes the riveter more suitable for use in smaller environments and helps make more efficient use of floor space on a shop floor.

Still further, the riveter disclosed herein is able to detachably engage one or more of a range of differently configured feed assemblies, each feed assembly being configured to hold and provide a different type of fastener or a different size of fastener for securing workpieces together. Each feed assembly includes a connector that is configured to engage a connection member on the riveter head. The connector is complementary to the connection member. A sample embodiment of a suitable connection member is a shaped slot provided on the riveter. The complementary connector that is provided on each of the different feed assemblies includes a first region that is interlockingly receivable into the shaped slot. A locking member secures the connector in the connection member. This arrangement enables the riveter disclosed herein to be used to secure workpieces together using a wide range of different fasteners, thus making the machine more versatile and therefore more cost effective to own.

Furthermore, a feed assembly is disclosed that has a rivet stop that is configured and positioned to automatically control the feed of rivets and other fasteners to a location where they are installed during operation of the riveter. The rivet stop thereby removes the need for the operator to depress buttons to move a single rivet into position prior to installation of the same. The provision of this rivet stop thus decreases the time required to join a number of different sets of workpieces and thus contributes to more efficient and less expensive production of joined workpieces.

In one aspect, the invention may provide a riveter and a feed assembly in combination, wherein the feed assembly is adapted to hold and feed a plurality of a first fastener; and wherein the feed assembly is selectively detachably engageable with the riveter.

In another aspect, the invention may further provide a riveter, a first feed assembly which holds and provides a plurality of first fasteners and a second feed assembly which holds and provides a plurality of second fasteners; and wherein each of the first and second feed assemblies are selectively detachably engageable with the riveter.

In another aspect, the invention may provide a method of using a riveter to secure two separate workpieces together; said method comprising the steps of providing a riveter having a base adapted to rest on a floor surface, a post extending upwardly from the base, a foot pedal extending outwardly from the post, a plunger mounted for reciprocal movement within the head, and a linkage assembly operatively engaged with the foot pedal and the plunger; wherein movement of the foot pedal in a first direction causes the linkage assembly to move the plunger within the head in a first manner; and movement of the foot pedal in a second direction causes the linkage assembly to move the plunger within the head in a second manner; providing a first feed assembly which holds and delivers a type of first fastener for securement of the workpieces; engaging the first assembly with the riveter; and operating the riveter to drive one or more of the first fasteners into the workpieces to secure the workpieces together.

In yet another aspect, the invention may provide a method which further comprises providing a second feed assembly which holds and delivers a type of second fastener for securement of the workpieces; selecting one of the types of first or second fasteners to secure the two workpieces together; selecting the associated one of the first and second feed assemblies; engaging the selected one of the first and second feed assemblies with the riveter; and operating the riveter to drive one or more of the selected first or second fasteners into the workpieces to secure the workpieces together.

In yet another aspect, the invention may provide a feed assembly for a riveter comprising a tumbler including a feed chute with an opening into which the plurality of the fasteners are adapted to be fed; a raceway extending downwardly from the tumbler and defining a feedslot therein which is adapted to receive fasteners therein one at a time from the tumbler; a pair of opposed spring arms secured to the raceway; a guide block provided on each spring arm; a channel defined between the guide blocks of the two spring arms, the channel being adapted to receive a lowermost fastener from the raceway therein; and wherein the plunger passes through the channel and is adapted to contact the lowermost fastener; and a rivet stop provided on one of the spring arms; said rivet stop being adapted to selectively contact a second from lowermost fastener in the raceway and prevent this second from lowermost fastener from moving downwardly along the raceway.

In a further aspect, the invention may provide a riveter which includes a feed assembly that comprises a tumbler including a feed chute with an opening into which the plurality of the fasteners are adapted to be fed; a raceway extending downwardly from the tumbler and defining a feedslot therein which is adapted to receive fasteners therein one at a time from the tumbler; a pair of opposed spring arms secured to the raceway; a guide block provided on each spring arm; a channel defined between the guide blocks of the two spring arms, the channel being adapted to receive a lowermost fastener from the raceway therein; and wherein the plunger passes through the channel and is adapted to contact the lowermost fastener; and a rivet stop provided on one of the spring arms; said rivet stop being adapted to selectively contact a second from lowermost fastener in the raceway and prevent this second from lowermost fastener from moving downwardly along the raceway.

In a further aspect, the invention may provide a method of using a riveter to secure two separate workpieces together; said method comprising the steps of providing a riveter having a base adapted to rest on a floor surface, a post extending upwardly from the base, a foot pedal extending outwardly from the post, a plunger mounted for reciprocal movement within the head, and a linkage assembly operatively engaged with the foot pedal and the plunger; wherein movement of the foot pedal in a first direction causes the linkage assembly to move the plunger within the head in a first manner; and movement of the foot pedal in a second direction causes the linkage assembly to move the plunger within the head in a second manner; providing a feed assembly on the riveter which holds and delivers plurality of fasteners for securement of the workpieces; providing a rivet stop on the feed assembly to control the feed of fasteners through a raceway of the feed assembly; and operating the riveter to drive a lowermost one of the fasteners in the raceway into the workpieces to secure the workpieces together.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

Similar numbers refer to similar parts throughout the drawings.

DETAILED DESCRIPTION

Figure 1:
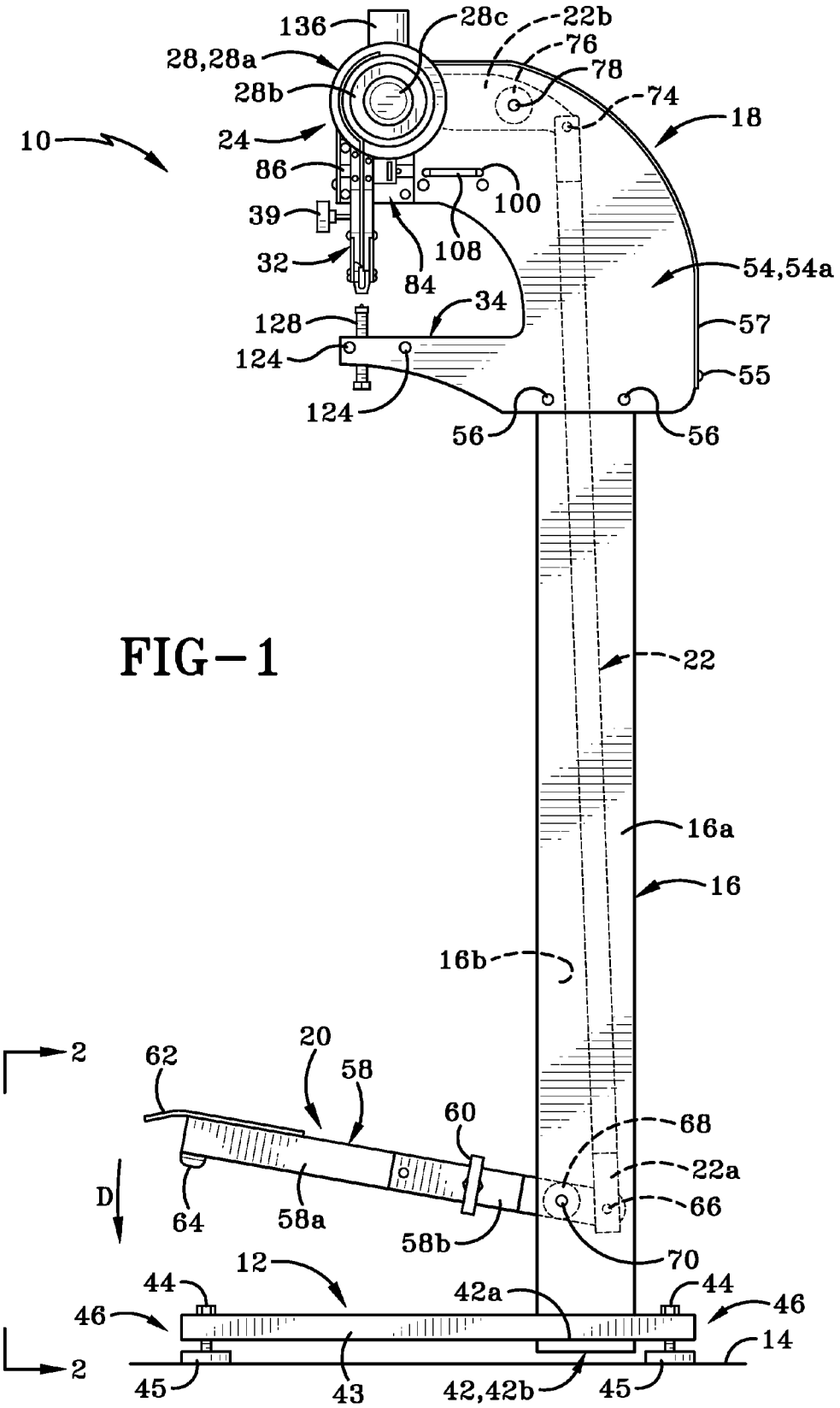
FIG. 1 is a right side elevational view of a foot operated riveter in accordance with an aspect of the present invention.

Referring to FIGS. 1-21, there is shown a riveter, generally indicated at 10. Riveter 10 includes a base 12 that rests on a ground or floor surface 14, a post 16 extending upwardly from base 12, and a head 18 mounted on an upper end of post 16. Post 16 is a tubular member defining a bore therein. A foot operated pedal 20 extends outwardly from post 16 and is operatively engaged with a linkage assembly 22. Part of linkage assembly 22 is located within the bore of post 16 and another part of linkage assembly 22 is located within an interior chamber of head 18. A plurality of feed assemblies are selectively detachably engageable with riveter 10. Each of these various feed assemblies is fabricated to deliver a different type of fastener for joining workpieces together. As illustrated in FIG. 1, for example, a first feed assembly 24 is detachably engageable with head 18 of riveter. Linkage assembly 22 is operatively engaged with a lever assembly 26 (FIG. 5) on feed assembly 24. Riveter 10 is generally operated by depressing foot pedal 20 toward floor surface 14. The motion of foot pedal 20 causes linkage assembly 22 to move lever assembly 26. Lever assembly 26 rotates a tumbler 28 of feed assembly 24 causing fasteners, such as rivets, 30 (FIG. 14) within tumbler 28 to be fed into a raceway 32 (FIG. 4). Linkage assembly 22 also moves a plunger 36 (FIG. 5) in one of a first or second manner, depending on the direction of movement of foot pedal 20. Linkage assembly 22 moves plunger 36 downwardly when foot pedal 20 is moved in a first direction. Linkage assembly 22 moves plunger 36 downwardly into a position where the plunger engages lowermost one of the rivets 30 at the end of raceway 32 of feed assembly 24. Two separate workpieces 38, 40 are positioned above a spreader mechanism 128 extending upwardly from platform 34 on head 18. Plunger 36 drives the lowermost rivet 30 downwardly and into workpieces 38, 40, securing them together. Linkage assembly 22 may also move plunger 36 upwardly within head 18 when food pedal 20 is moved in a second direction. All of the various components and the operation of riveter 10 will be described in greater detail herein.

Figure 4:
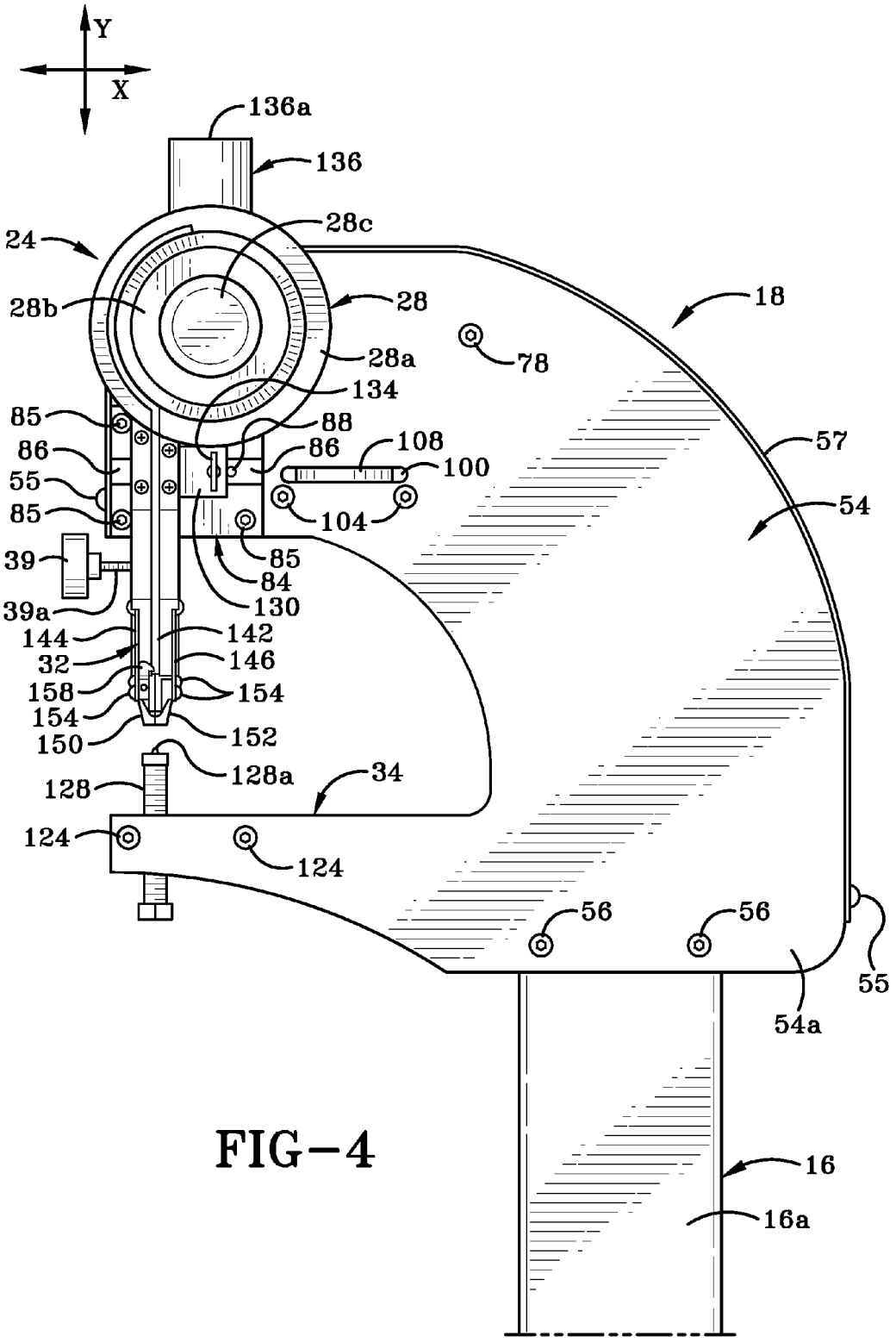
FIG. 4 is an enlarged right side elevational view of the head of the riveter.
Figure 5:
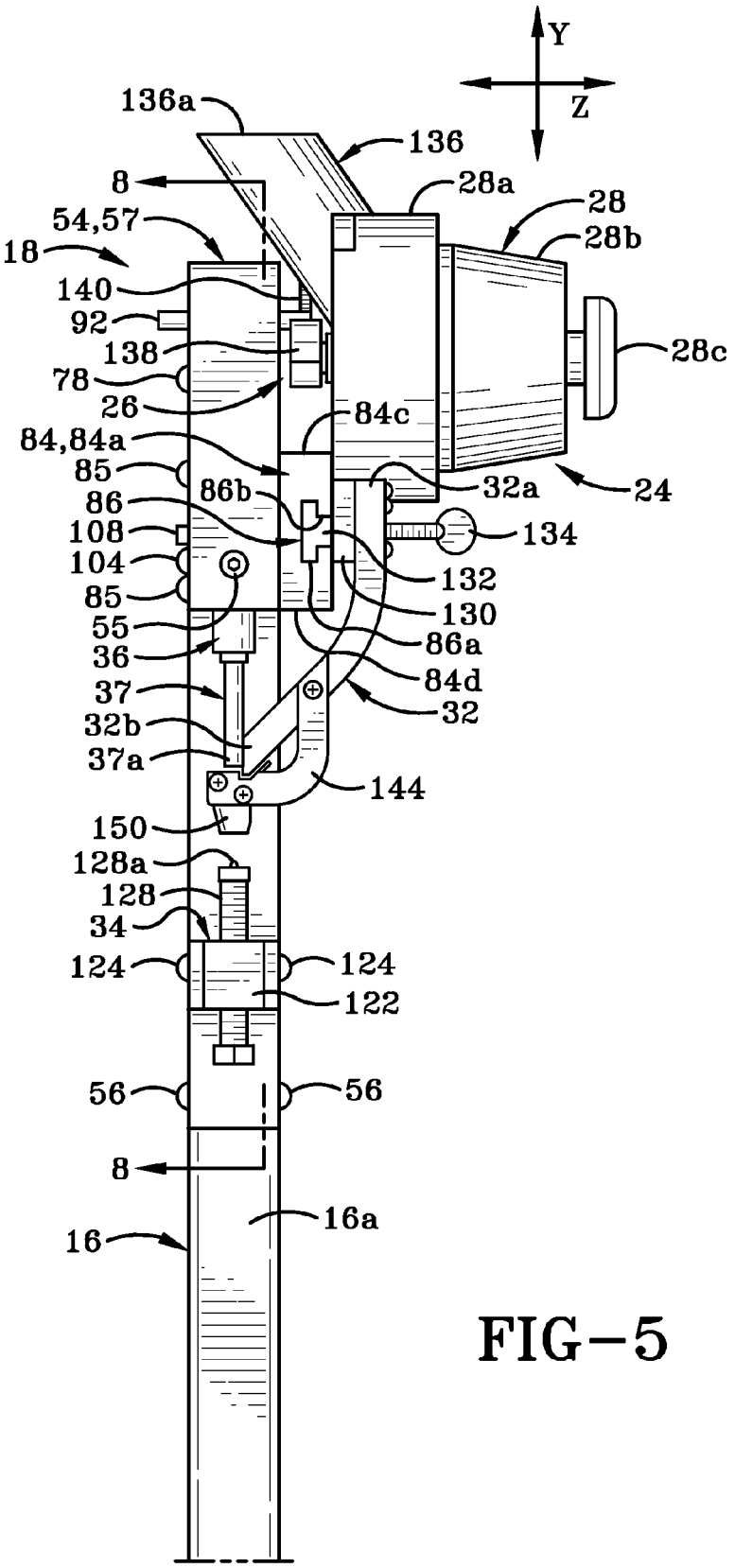
FIG. 5 is a front elevational view of the head of the riveter.

Before proceeding with the description, a frame of reference is set out herein on FIGS. 4 and 5 to define three axes of motion through which components of the riveter 10 may move. Vertical motion (up-and-down motion) occurs along an axis "Y", horizontal motion (back-and-forth motion) occurs along an axis "X" and lateral motion (side-to-side) motion occurs along an axis "Z".

Figure 2:
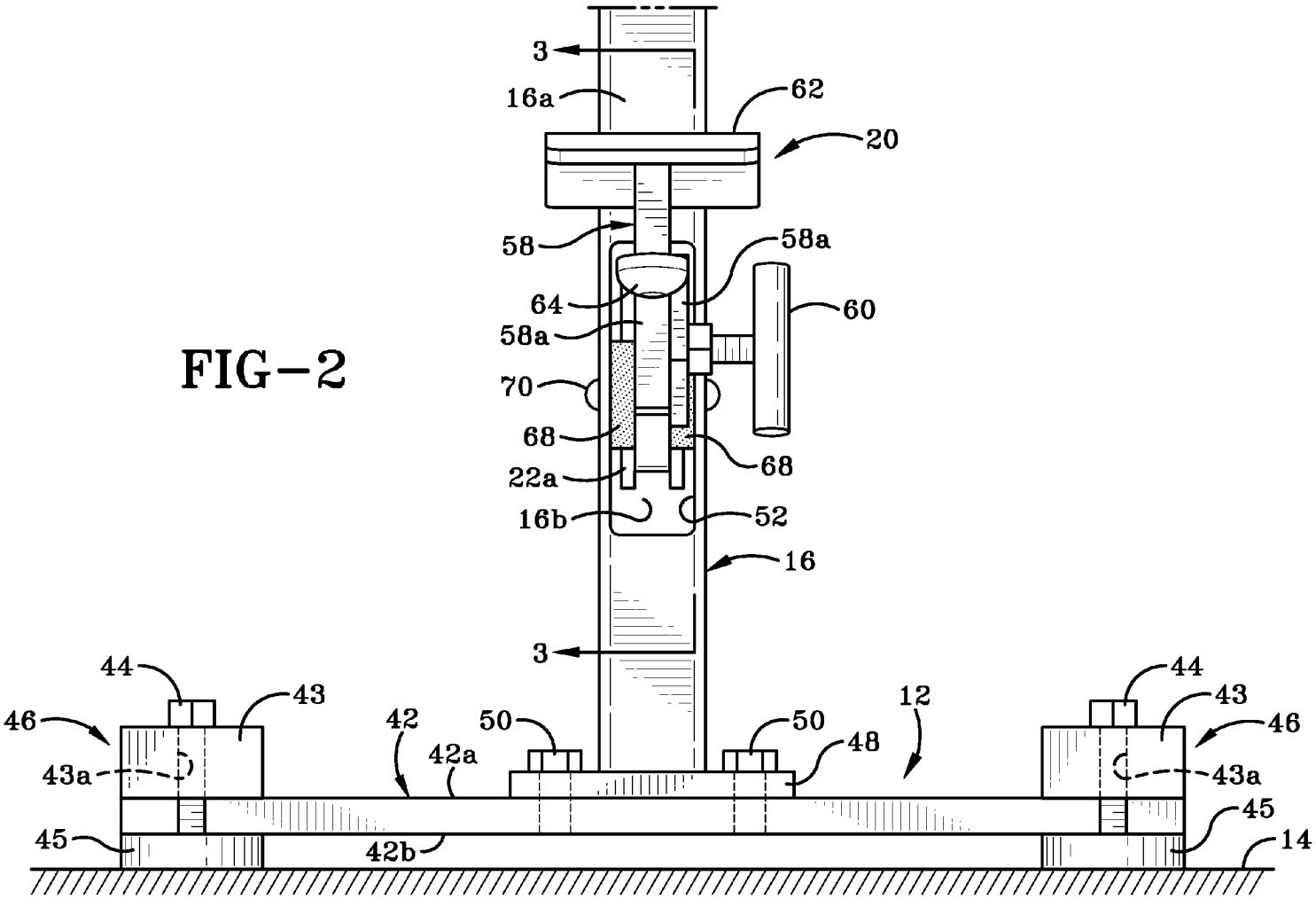
FIG. 2 is an enlarged front elevational view of the foot pedal taken along line 2-2 of FIG. 1.

Referring to FIG. 2, base 12 comprises a plate 42, at least a pair of spaced-apart side-bars 43, and a plurality of adjustable feet 46. Plate 42 has an upper surface 42*a* and lower surface 42*b*. A hole 42*a* is defined proximate each corner of upper surface 42*a* of plate 42 and apertures 42*a* are through holes between upper and lower surfaces 42*a*, 42*b*. Holes 43*a* are also defined between upper and lower surfaces of side-bars 43 and hole 42*a* and 42*a* are aligned with each other. A shaft 44*a* of a bolt 44 is inserted through each set of aligned holes 42*a*, 43*a* and a ground-engaging member 45 is threadably engaged with the end of each bolt 44. The user will rotate members 45 about an axis extending through shaft 44*a* in one of a first and second direction to alter the distance between lower surface 42*b* of plate 42 and the floor surface 14. The user will selectively adjust each foot 46 so that plate 42 is substantially horizontally leveled.

Figure 3:
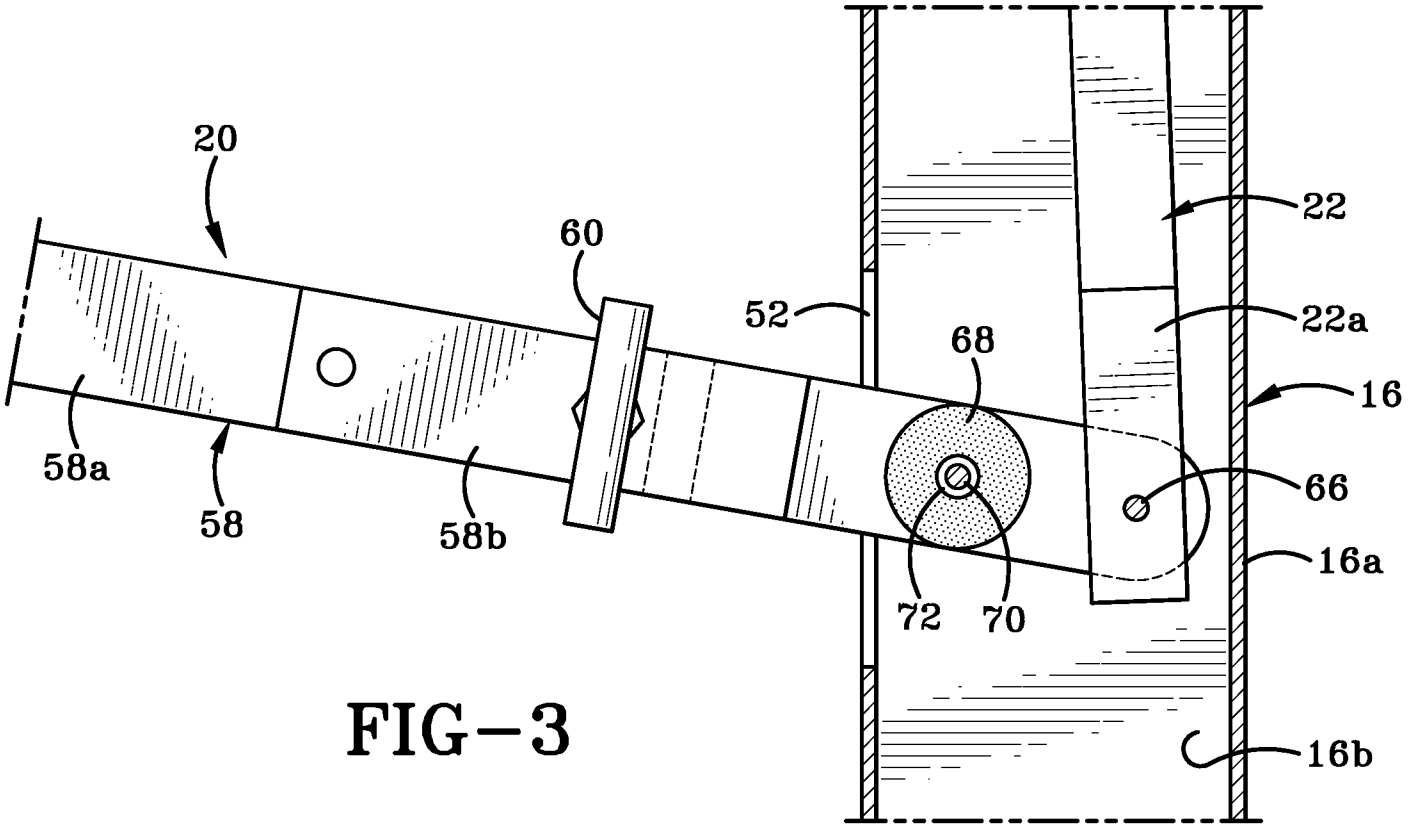
FIG. 3 is a right side cross-sectional view taken along line 3-3 of FIG. 2.

As shown in FIGS. 2 and 3, post 16 is a generally hollow tubular member having a peripheral wall 16*a* that bounds and defines an interior cavity 16*b*. A mounting bracket 48 is provided at a lower end of post 16 and a plurality of fasteners 50 are used to secure bracket 48 to plate 42. An aperture 52 is defined in a front region of peripheral wall 16*a* and this aperture 52 is in communication with cavity 16*b*. An upper end of post 16 is secured to a housing 54 of head 18 by a plurality of other fasteners 56 as will be further described herein.

Referring to FIGS. 1-3 foot pedal 20 includes an elongate leg 58 that may be comprised of one or more members. As illustrated, leg 58 may include a first member 58*a* and a second member 58*b* that are secured together by any suitable means, such as by way of a locking member 60. A pressure pad 62 is engaged on an upper surface of leg 58 at a first end thereof and a rubber stop 64 is engaged on a lower surface of leg 58 and at the first end thereof. The second end of leg 58 is engaged to a first arm 22*a* of linkage assembly 22 by way of a first pivot rod 66. Spacers 68 are engaged with leg 58 via fasteners 70 and a bushing 72 may be provided on each spacer 68 to ensure fluid movement of foot pedal 20.

Linkage assembly 22 further includes second arm 22*b* (FIGS. 1 and 8) which is secured to first arm 22*a* by way of a second pivot rod 74. Second spacers 76 separate second arm 22*b* from the interior surfaces of housing 54 of head 18. Second spacers are secured to housing 54 by fasteners 78 and a bushing 80 is provided to ensure fluid movement of second arm 22*b*, as will be further described herein.

Housing 54 of head 18 comprises a plurality of sheets of a material, such as metal, which form first and second sides 54*a*, 54*b* and front/top/back 57 of housing 54. The sheets of material may be bolted together, such as by fasteners 55 and 56. Spacer blocks 53 (FIG. 7) and 59 (FIG. 8) may be positioned to provide stable locations into which fasteners 55, 56 are secured. Spacer block 53 extends partially into interior cavity 16*b* of post 16 and partially into cavity 82 of head 18. Fasteners 56 secure spacer block 53 to the sides 54*a*, 54*b* of housing 54 and to the side walls (not numbered) of post 16. Fasteners 55 secure spacer block 59 to front/top/back 57 of housing 54. Alternatively or additionally, the sheets of metal may be welded together. Sides 54*a*, 54*b* and front/top/back 57 of housing bound and define an interior cavity 82 (FIG. 8) within which various components of riveter 10 are located. Housing 54 protect such components.

Head 18 further includes a first mounting block 84 (FIG. 21) and a second mounting block 87 (FIG. 8) that are secured to housing 54 by way of fasteners 85. Blocks 84 and 87 may be fabricated from a solid piece of metal. Block 84 includes a front face 84*a*, a rear face 84*b*, a top face 84*c*, and a bottom face 84*d*. Block 87 includes a front face 87*a*, a rear face 87*b*, a top face 87*c*, and a bottom face 87*d*. Block 87 is positioned between side walls 54*a*, 54*b* of housing 54. Block 84 is positioned adjacent side wall 54*a* and generally aligned with and proximate to block 87. It will be understood that blocks 84 and 87 may instead comprise a single unitary block and side wall 54*a* of housing 54 may include a cut-out to allow a portion of this single block to extend outwardly from the interior 82 of housing 54.

Figure 8:
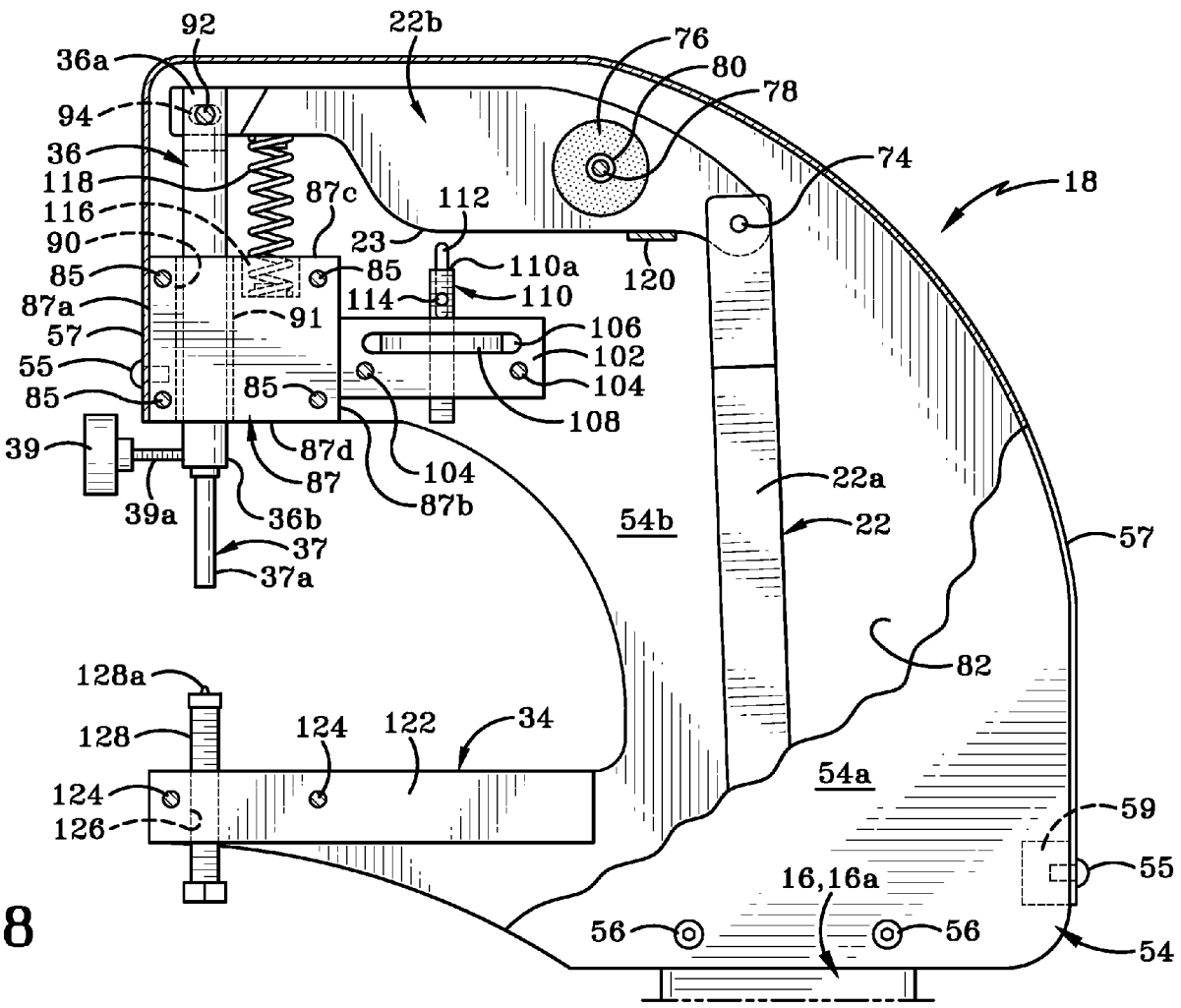
FIG. 8 is right side cross-sectional view of the head of the riveter taken along line 8-8 of FIG. 5 with the outer side plate partially cut-away to permit the interior of the head to be seen.
Figure 21:
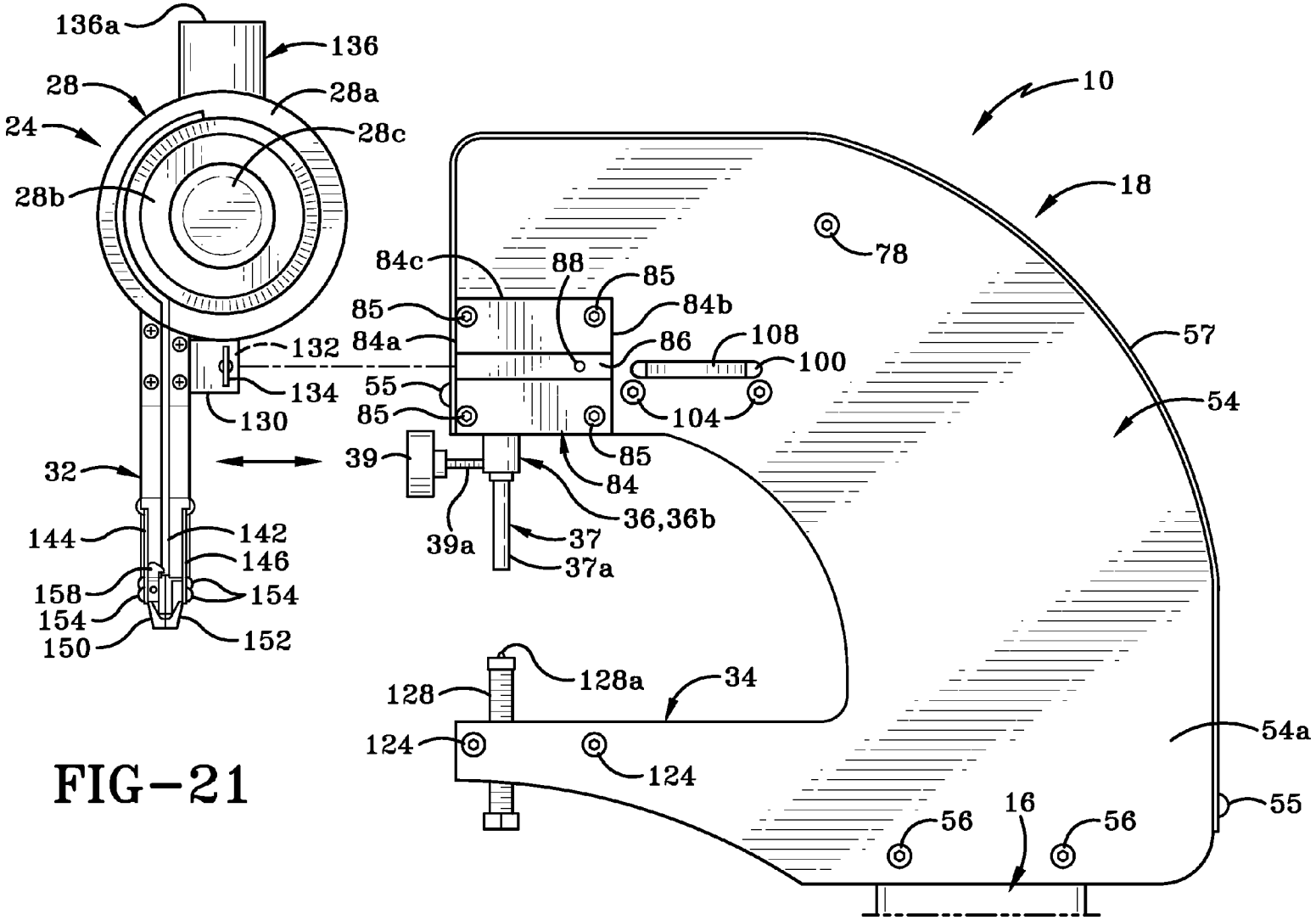
FIG. 21 is a right side view of the head of the riveter with the feed assembly disengaged therefrom.

Block 84 defines a slot 86 therein and with which feed assembly 24 is detachably engaged by way of a connector that is at least partially complementary shaped to slot 86. FIG. 21 shows that slot 86 is generally horizontally oriented, i.e., aligned parallel to horizontal axis "X". It will be understood, however, that slot 86 may be differently oriented and that feed assembly 24 will be configured to interlockingly engage with slot 86 no matter the orientation of that slot. Slot 86 is shaped so that a complementary shaped first region of feed assembly 24 will dovetail therewith. Slot 86 may be generally T-shaped in cross-section as shown in FIG. 8, for example. Feed assembly 24 includes a connector having a first region 132 that is complementary to the T-shaped slot 86 and this first region 132 dovetails with slot 86. It will be understood that slot 86 and first region 132 may be of any other suitable complementary cross-sectional shapes to interlockingly dovetail with each other. Furthermore, every additional feed assembly that is to be engaged with riveter 10, such as second feed assembly 224 (FIG. 22), will include a connector that is at least partially complementary to the cross-sectional shape of slot and is configured and oriented to be received in slot 86. This arrangement ensures that any additional feed assembly may be selectively detachably engaged with riveter 10 in the place of feed assembly 24. This will be further described herein.

An opening (not numbered) to slot 86 is defined in front face 84*a* and rear face 84*b* (FIG. 7) of block 84. Additionally, an opening (not numbered) to slot 86 is defined in an appropriate face of head 18. Obviously, the two openings are aligned with each other. As is evident from FIG. 5 and FIG. 13, T-shaped slot 86 includes a first narrower but taller region 86*a* and a second wider but shorter second region 86*b*. Regions 86*a* and 86*b* extend for substantially the entire length of slot from front face 84*a* to rear face 84*b*. An assembly stop 88 (FIG. 7) extends outwardly from an interior wall of block 84 which defines slot 86. Assembly stop 88 is a projection positioned a spaced distance inwardly from the opening to slot 86 in front face 84*a* of block 84 and therefor from the front face of housing 54 or head 18. Assembly stop 88 extends into slot 86 and is provided to limit the inward travel of feed assembly 24 away from the front face of head 18 which defines the opening to slot 86. This positioning of assembly stop 88 ensures that any feed assembly, such as feed assembly 24, will be positioned on block 84 in an operational position.

Figure 13:
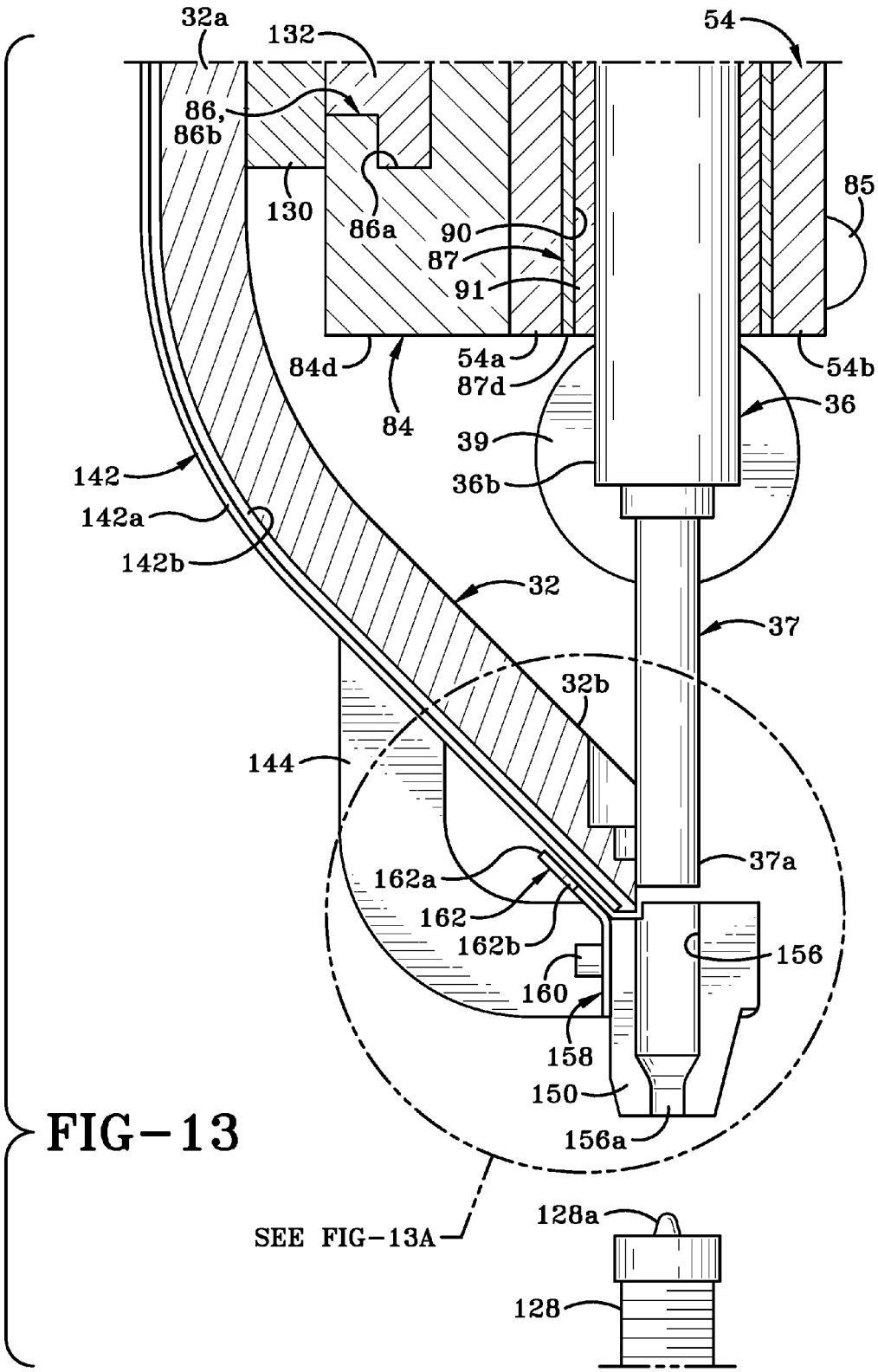
FIG. 13 is a right side cross-sectional view of the feed assembly taken along line 13-13 of FIG. 12.
Figure 13A:
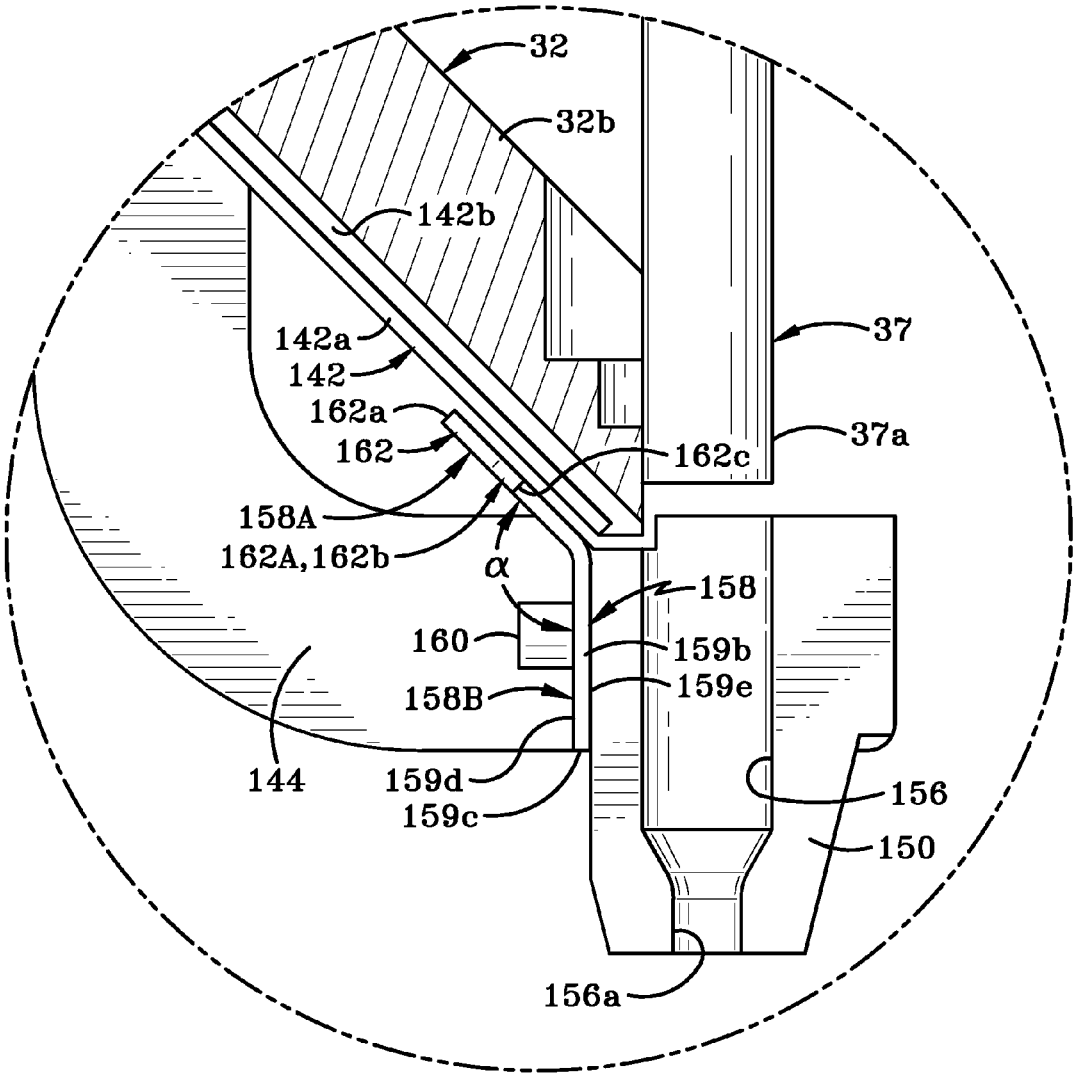
FIG. 13A is an enlargement of the highlighted region of FIG. 13.

As shown in FIGS. 8 and 13, block 87 defines a vertically oriented bore 90 therethrough which originates in top face 87*c* and terminates in bottom face 87*d*. Bore 90 is spaced a distance inwardly from each of front face 87*a* and rear face 87*b*. A bushing 91 lines bore 90. Riveter 10 further includes a plunger 36 which has a first end 36 and a second end 36*b*. First end 36*a* of plunger 36 is secured to a front end of second arm 22*b* of linkage assembly 22 by a rod 92. The body of plunger 36 passes through a hole (not numbered) in bushing 91 positioned in block 87. Although not illustrated in the figures, plunger 36 includes a recess defined in second end 36*b* thereof. A first end of a replaceable tip 37 is received in this recess. A handle 39 with a threaded shaft 39*a* extending outwardly therefrom is provided to lock tip 37 in this recess in plunger 36. A free end of shaft 39*a* is inserted through an aperture in the side wall of plunger 36. Handle 39 is rotated in a first direction to cause the free end of the shaft 39*a* to advance inwardly into the recess and contact the side of tip 37. Further rotation of handle 39 in the first direction will clampingly lock tip 37 against a portion of the interior surface of plunger 36 which defines the recess therein. When it is desired to remove tip 37 and replace it with a differently configured tip, handle 39 is rotated in a second direction to break the clamping contact between shaft 39*a* and tip 37. Tip 37 will then be able to move out of the recess and the end of a replacement tip will be inserted into recess and locked into position by rotating handle 39 in the first direction. Tip 37 has a rivet-engaging end 37*a* which contacts the head of a rivet 30 held by feed assembly 24 when riveter 10 is being used. The use of riveter 10 will be later described herein.

Figure 6:
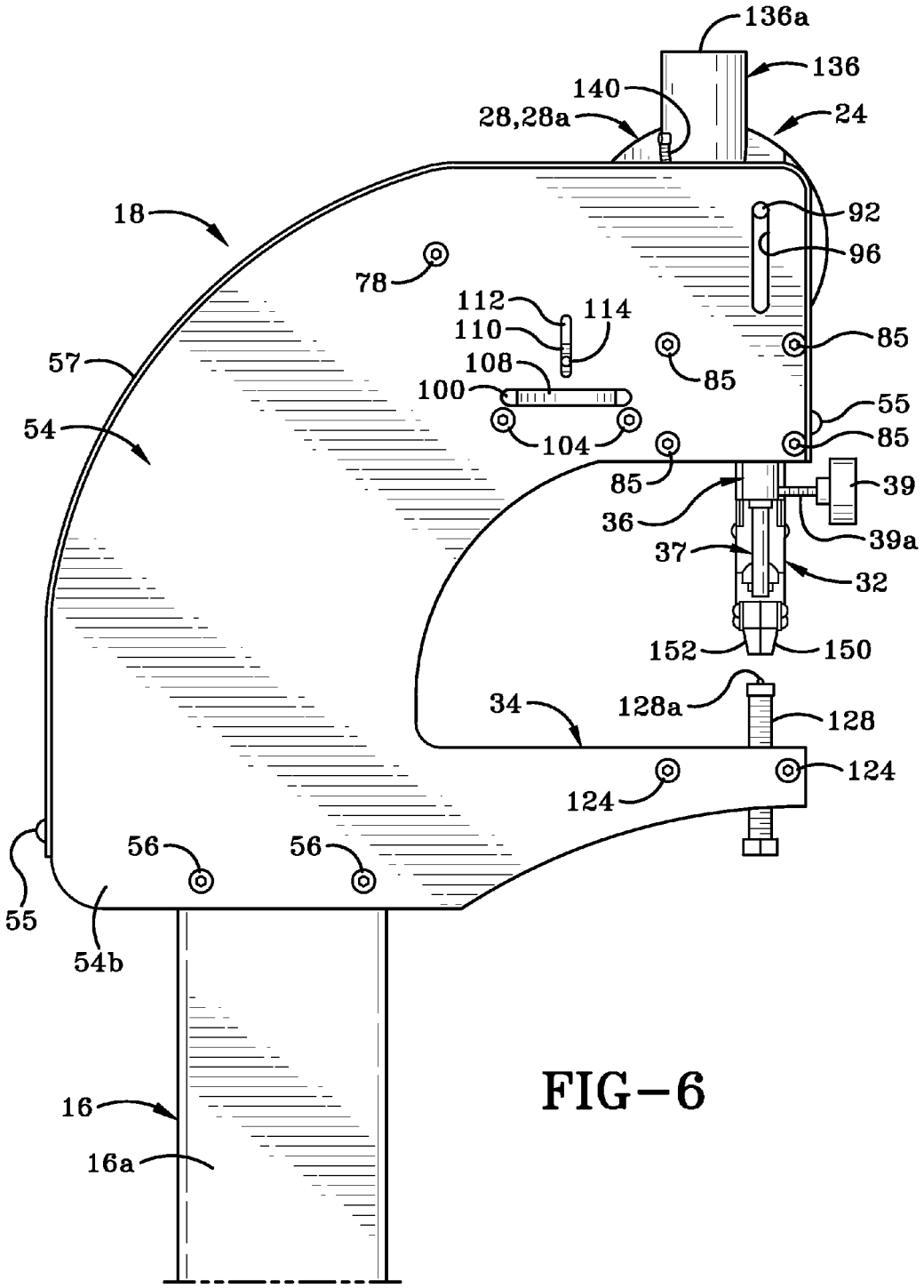
FIG. 6 is a left side elevational view of the head of the riveter.

FIG. 8 shows that the rod 92 operatively engaged with linkage assembly 22 passes through a slot 94 defined in first end 36*a* of plunger 36. Rod 92 also extends through a pair of vertically-oriented and aligned slots defined in opposing side walls 54*a*, 54*b* of housing 54. One of these slots is shown in FIG. 6 and is identified by reference character 96. When foot pedal 20 is depressed and released, rod 92 is caused to move vertically up and down in slots 96 and as a result, plunger 36 is caused to move vertically up and down within the hole in bushing 91. The movement of plunger 36 in turn moves tip 37 vertically up and down.

The reciprocal vertical travel of plunger 36 through the hole in bushing 91 and parallel to axis "Y" is adjustable. To that end, housing 54 defines a further pair of aligned slots 100 therein with each slot 100 being defined in one of the side walls 54*a*, 54*b* of housing 54. A first slot 100 is illustrated in FIG. 4 and the other slot 100 is illustrated in FIG. 6. FIG. 8 shows that a third mounting block 102 is secured to housing 54 adjacent rear face 87*b* of mounting block 87 by way of fasteners 104. Blocks 87 and 102 may be welded or otherwise secured to each other to provide more strength and stability to housing 54 or may even be part of a single integral block. FIG. 8 also shows that a slot 106 is defined in second block 102 and this slot 106 is aligned with slots 100 in the side walls of housing 54. A dial 108 is mounted within slot 106 by way of a threaded rod 110. (Rod 110 passes through an aperture (not numbered) within dial 108.) An additional vertical slot 112 (FIG. 6) is defined in one of the side walls of housing 54. An adjustment pin 114 is provided on rod 110 and this pin 114 extends through vertical slot 112. When dial 108 is rotated about a vertical axis that extends through rod 110, because pin 114 is captured within slot 112, the rotation of the dial 108 will cause rod 110 to move vertically upward or downward. This vertical motion along axis "Y" will cause the upper end 110*a* of rod 110 to move toward or away from second arm 22*b* of linkage assembly 22. When second arm 22*b* pivots in response to the depression or release of the foot pedal 20, the lower surface 23 of second arm 22*b* will move relative to upper end 110*a* of rod 110. The distance between upper end 110*a* and lower surface 23 dictates the length of travel of plunger 36 along axis "Y". When plunger 36 moves downwardly, lower surface 23 of second arm 22*b* will contact upper end 110*a* of rod 110 and further downward motion will be prevented. If it is determined that the distance plunger 36 is moving downwardly is insufficient then dial 108 will be rotated in a first direction to move upper end 110*a* further away from lower surface 23. If it is determined that the distance plunger 36 is moving downwardly is too great, then dial 108 will be rotated in a second direction to move upper end 110*a* closer to lower surface 23.

Block 87 further defines a recess 116 in top face 87*c* thereof. A compression spring 118 anchored at a first end on second arm 22*b* of linkage assembly 22 has a second end that is received in recess 116. When second arm 22*b* moves in response to foot pedal 20 being depressed, as will be further described herein, plunger 36 is moved downwardly to cause a rivet 30 in raceway 32 to secure workpieces 38, 40 together. This downward motion of plunger 36 causes spring 118 to be compressed. When pressure on foot pedal 20 is released, compression spring 118 assists in moving plunger 36 and second arm 22*b* back to their at-rest position.

FIG. 8 shows that a stop 120 is provided on housing 54 in a position beneath lower surface 23 of second arm 22*b* and in a location proximate pivot 74. Stop 120 limits the vertical downward motion of second arm 22*b* as second arm 22*b* pivots about rod 74.

A third block 122 (FIG. 8) is mounted to housing 54 by way of fasteners 124. The upper surface of third block 122 serves as the platform 34 of head 18. A through-hole 126 is defined in block 122 and a spreader screw 128 extends upwardly through hole 126 and toward tip 37. Spreader screw 128 includes an upwardly extending tip 128*a* that is sized to be received into an opening at the bottom end of a tubular shaft 30*b* of a rivet 30 and to split and spread that shaft 30*b*. The configuration of the spreader screw 128 and the manner in which it functions is known in the art and thus will not be further described herein.

Feed assembly 24 is a detachable component that is selectively engaged with riveter 10. Feed assembly 24 comprises tumbler 28 and a raceway 32. A mounting block 130 (FIG. 4) is provided on raceway 32. As indicated previously, the connector which secures feed assembly 24 to riveter 10 includes a generally T-shaped first region 132 (best seen in FIG. 13). First region 132 extends outwardly from mounting block 130 and is insertable into the opening (not numbered) in head 18 and front face 84*a* of block 84 and into slot 86 defined therein. First region 132 is interlockingly engageable in slot 86 and is movable therealong. First region 132 may be slid along slot 86 to the point that the connector engages assembly stop 88 so that feed assembly 24 is in the operational position.

The connector on feed assembly 24 also includes a locking member for locking feed assembly 24 to riveter 10 in a fixed position when feed assembly 24 is in this operational position. The locking member prevents relative motion between first region 132 of connector and slot 86 and thereby between feed assembly 24 and head 18. The locking member may comprise a thumbscrew 134 (FIG. 4). When thumbscrew 134 is rotated in a first direction, thumbscrew 134 urges first region 132 into frictional locking engagement with the portions of mounting block 84 which define slot 86. Thumbscrew 134 is thus in a locked position, locking first region 132 to mounting block 84 and preventing relative motion between first region 132 and slot 86. This prevent relative motion between feed assembly 24 and head 18 of riveter 10. Thumbscrew 134 is rotated in a second direction to an unlocked position, thereby releasing pressure on first region 132. When this occurs, relative motion between first region 132 and slot 86 is again possible. Consequently, feed assembly 24 is able to move relative to head 18. Feed assembly 24 is only able to be engaged with or disengaged from riveter 10 when thumbscrew 134 is rotated in the second direction. Riveter 10 is only able to rivet workpieces together when feed assembly 24 is engaged therewith and thumbscrew 134 has been rotated in the first direction.

Figure 10:
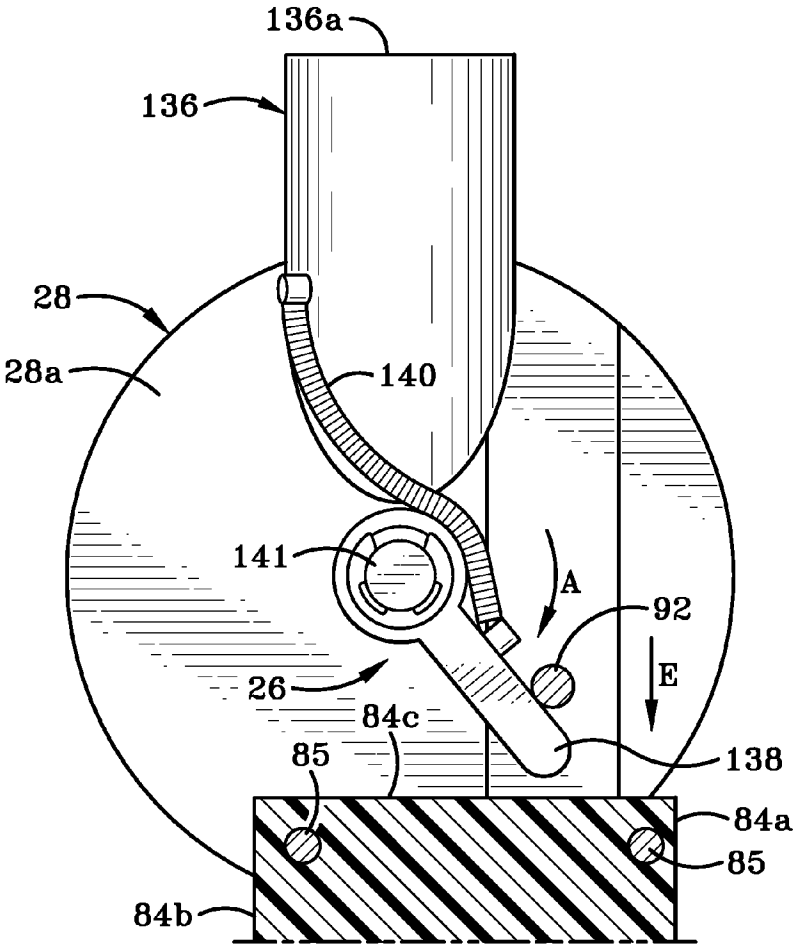
FIG. 10 is a partial cross-sectional view of the lever assembly of FIG. 9 with the lever shown in a second position.
Figure 9:
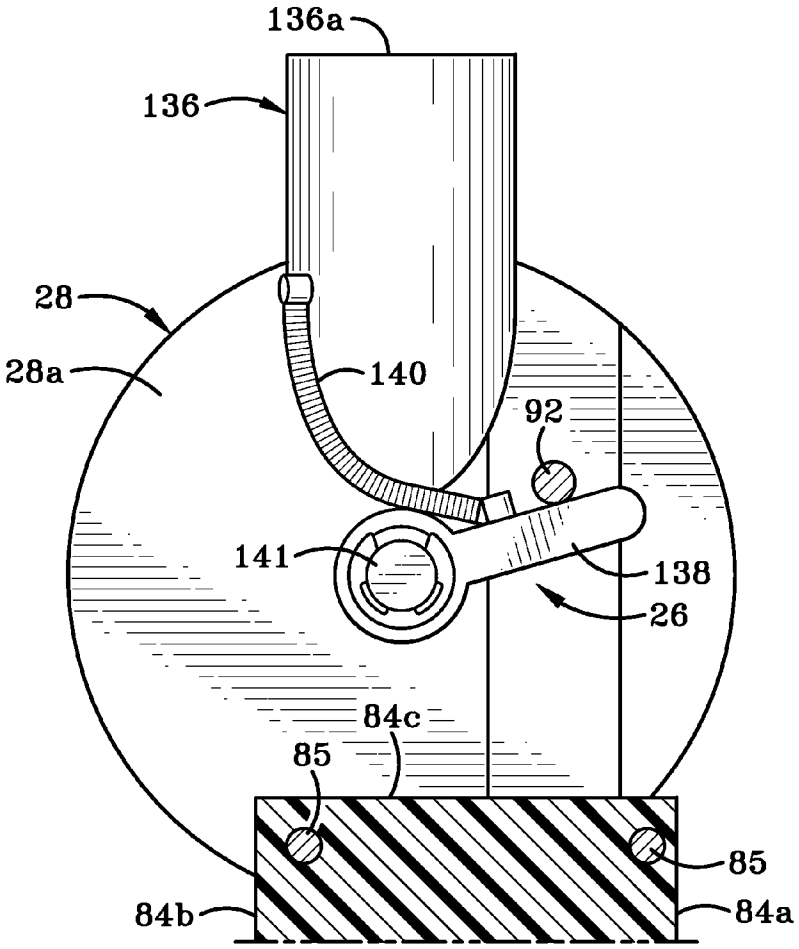
FIG. 9 is partial cross-sectional view of the lever assembly which rotates the tumbler taken along line 9-9 of FIG. 5 and showing the lever in a first position.
Figure 11:
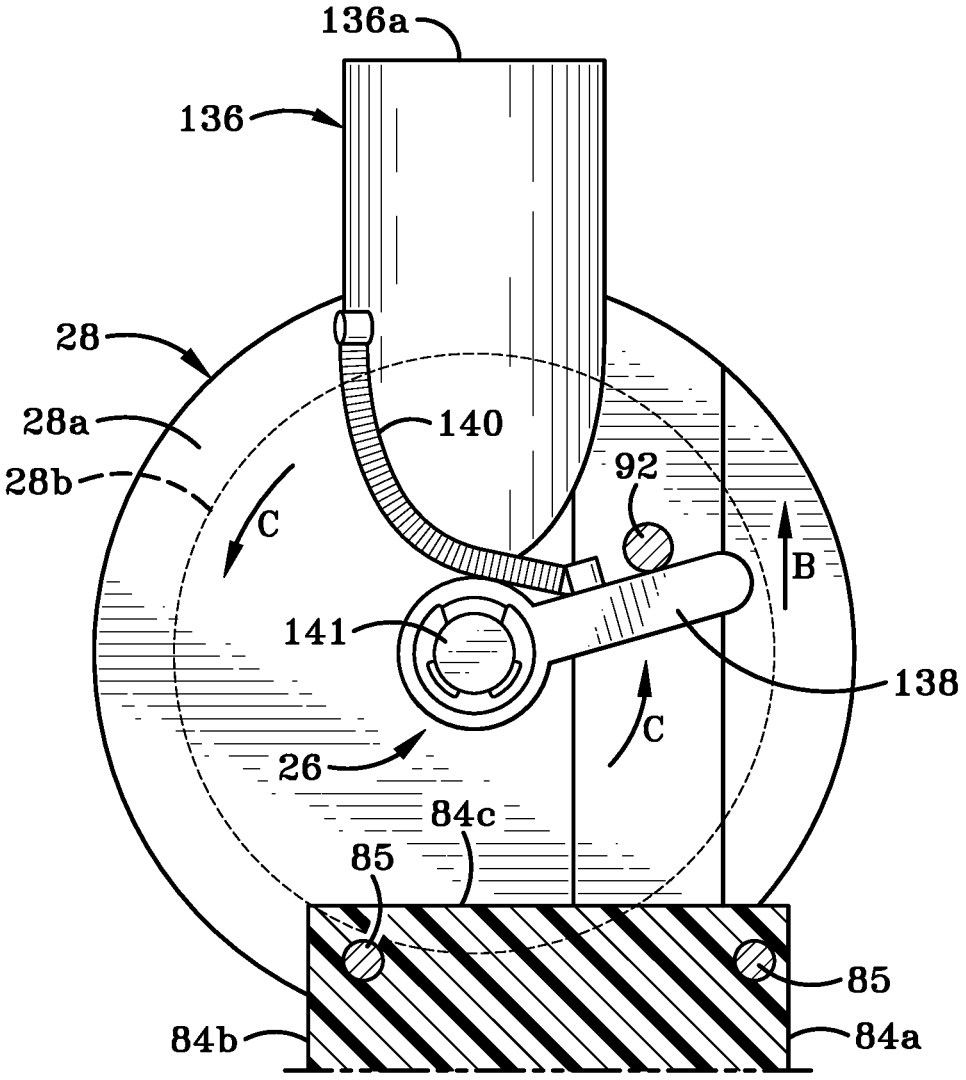
FIG. 11 is a partial cross-sectional view of the lever assembly of FIG. 9 with the lever shown returning to the initial position and showing rotation of the tumbler caused by the return of the lever to the initial position.

Referring to FIG. 5, tumbler 28 includes a first section 28*a* that is fixed to block 130 and the upper end 32*a* of raceway 32. Tumbler 28 further includes a second section 28*b* that is rotatably engaged with first section 28*a* and is adjustably secured thereto by a securement member 28*c*. A feed chute 136 is connected to first section 28*a* and includes an opening (not shown) in the upper end 136*a* thereof. Rivets may be fed into first section 28*a* of tumbler 28 through feed chute 136 and rivets then proceed from stationery first section 28*a* to rotatable second section 28*b*. Lever assembly 26 is provided to cause second section 28*b* of tumbler 28 to rotate. Referring to FIGS. 9-11, lever assembly 26 includes a lever arm 138 that is mounted on a shaft 142 that connects lever arm 138 to first section 28*a* of tumbler 28. A spring 140 is connected at a first end to feed chute 136 and at a second end to lever arm 138. Lever arm 138 is rotatable about a horizontal axis which extends along shaft 142. This rotation is caused by movement of rod 92 which is connected to plunger 36. As plunger 36 is moved downwardly in response to depression of foot pedal 20, lever arm 138 moves from a first position shown in FIG. 9 to a second position shown in FIG. 10. This downward motion, indicated by arrow "A" in FIG. 10, stretches spring 140. As plunger 36 moves upwardly when pressure is removed from foot pedal 20, spring 140 returns to its original length, pulling lever arm 138 upwardly in the direction of arrow "B" (FIG. 11) and returning lever arm 138 to the first position. The upward motion of lever arm 138 causes shaft 142 to rotate in the direction of arrow "C" (FIG. 11) and this rotation in turn causes rotation of second section 28*b* of tumbler.

Figure 14:
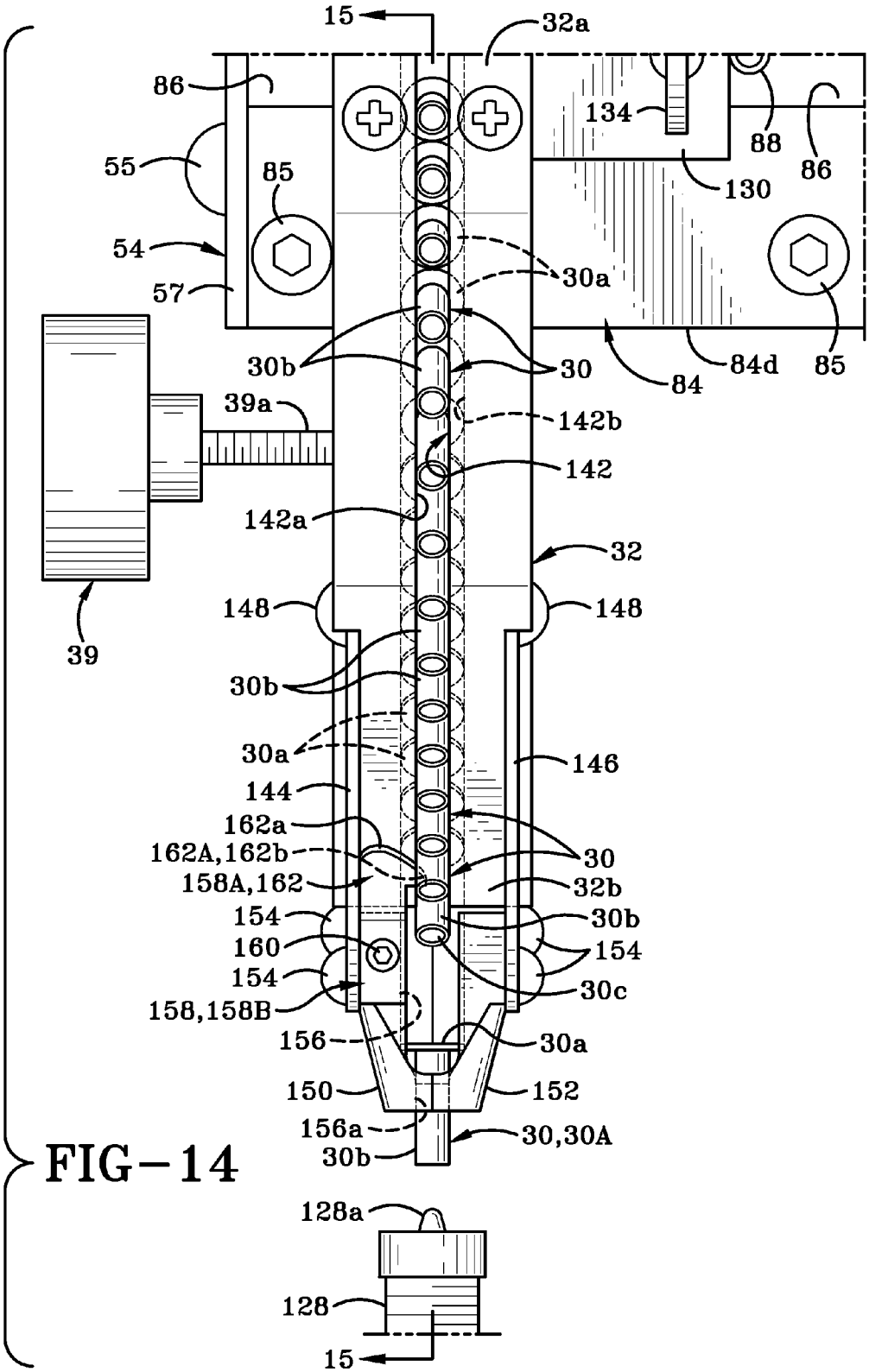
FIG. 14 is an enlarged front elevational view of the feed assembly that is loaded with rivets.
Figure 17:
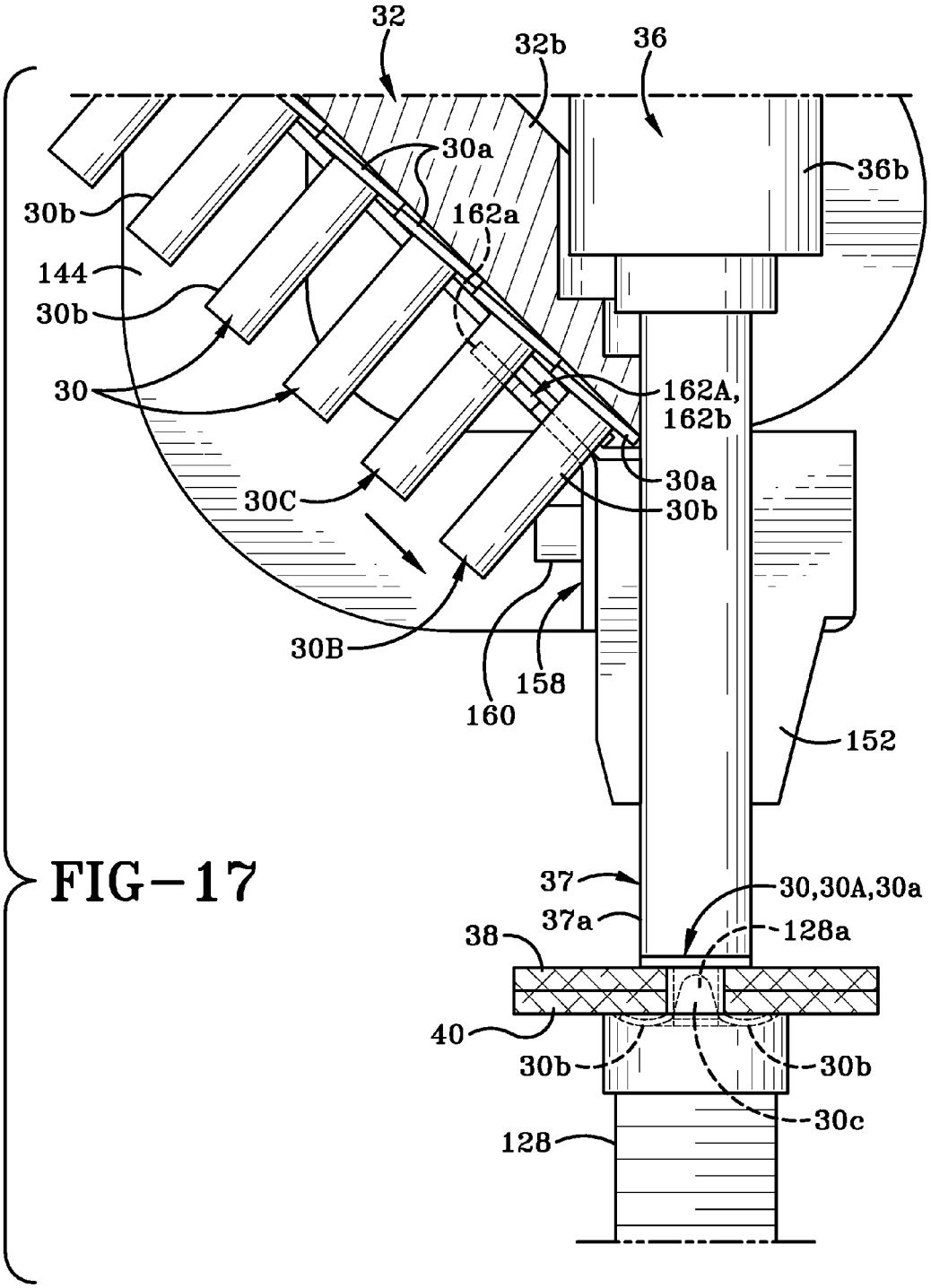
FIG. 17 is a right side cross-sectional view of the feed assembly taken along line 17-17 of FIG. 16.
Figure 18:
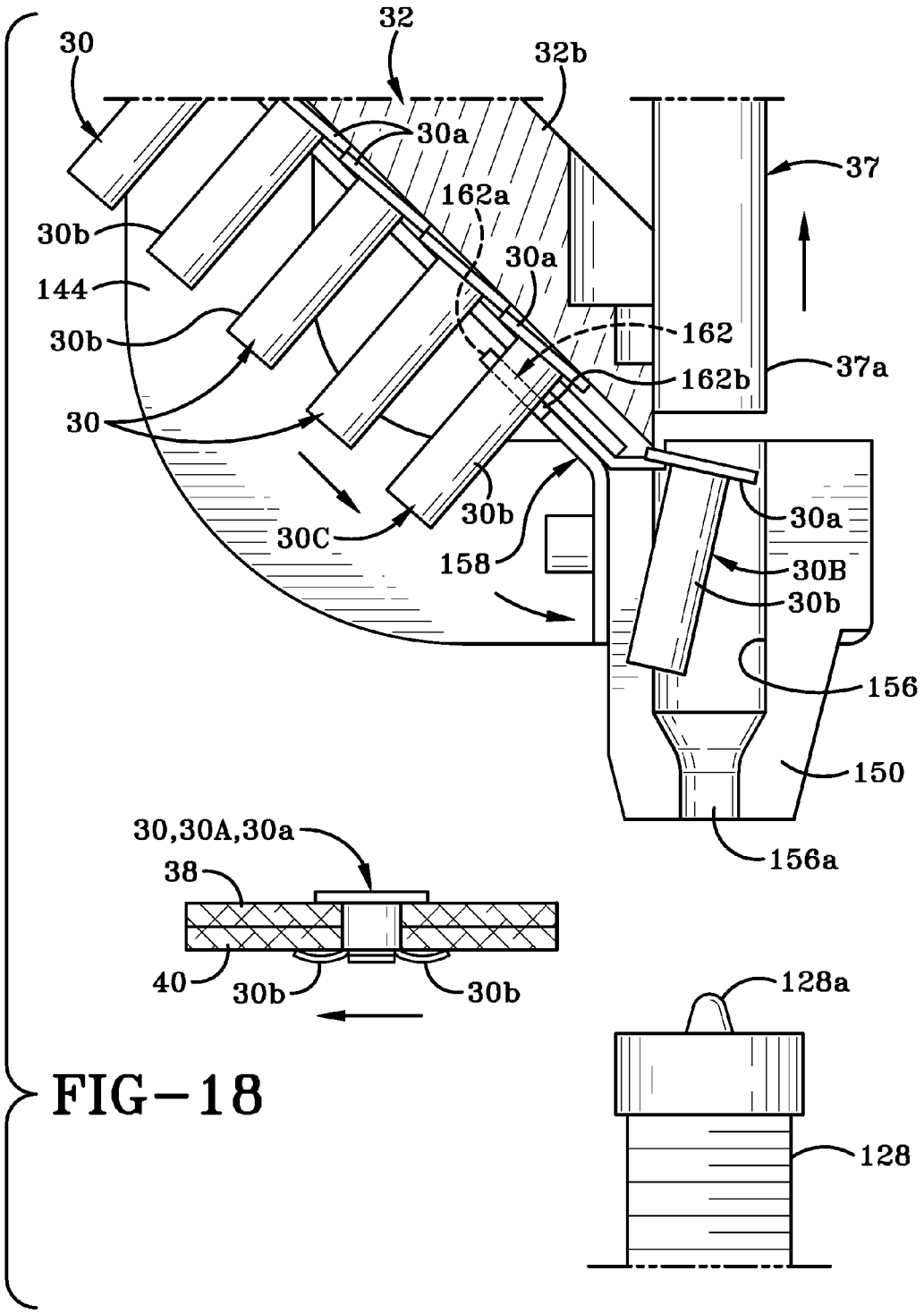
FIG. 18 is a right side cross-sectional view of the feed assembly of FIG. 17 with the plunger being moved to a retracted position and a next rivet dropping into the feed chute.
Figure 19:
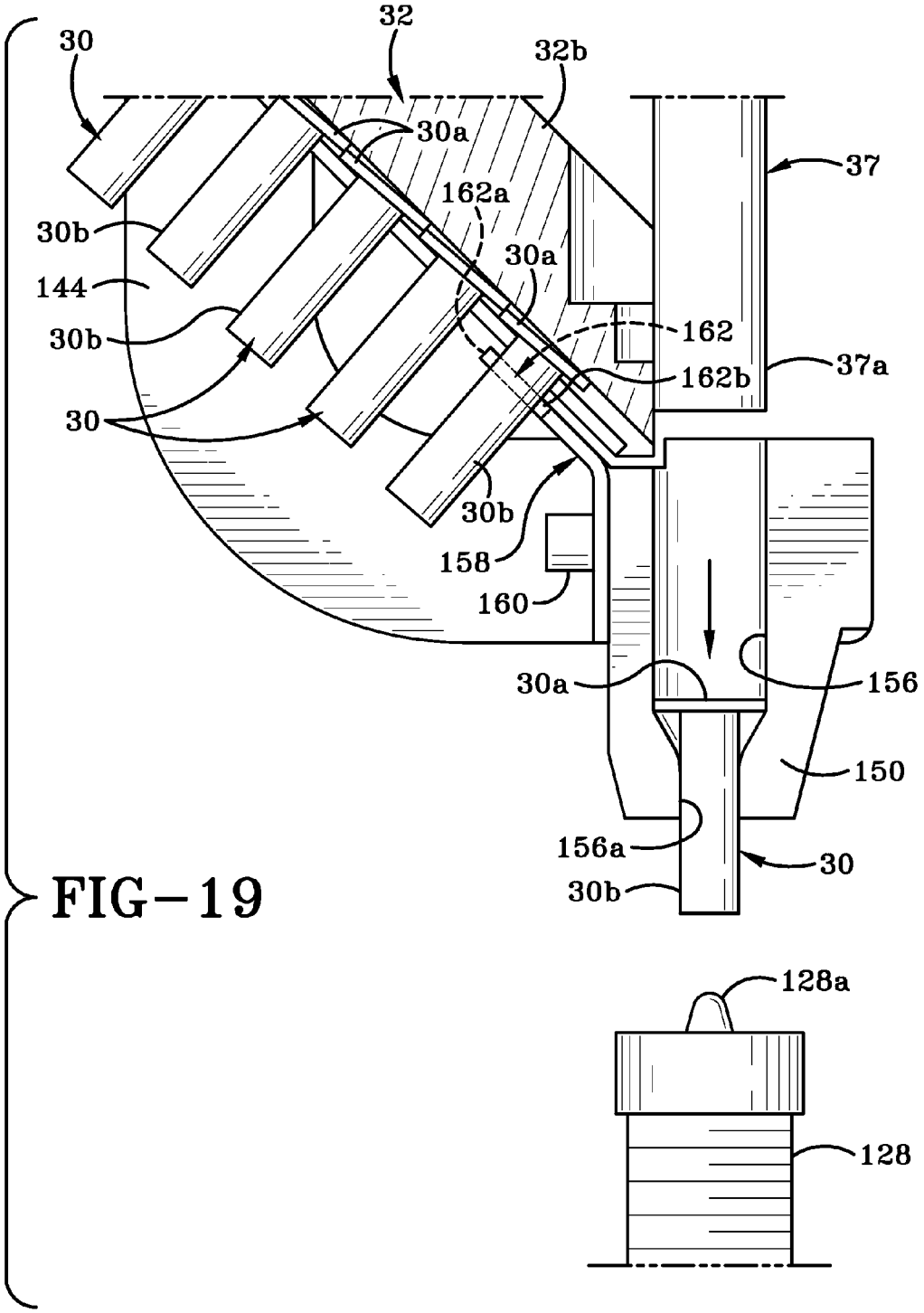
FIG. 19 is a right side cross-sectional view of the feed assembly of FIG. 18, with the next rivet positioned in the ready position for riveting.
Figure 20:
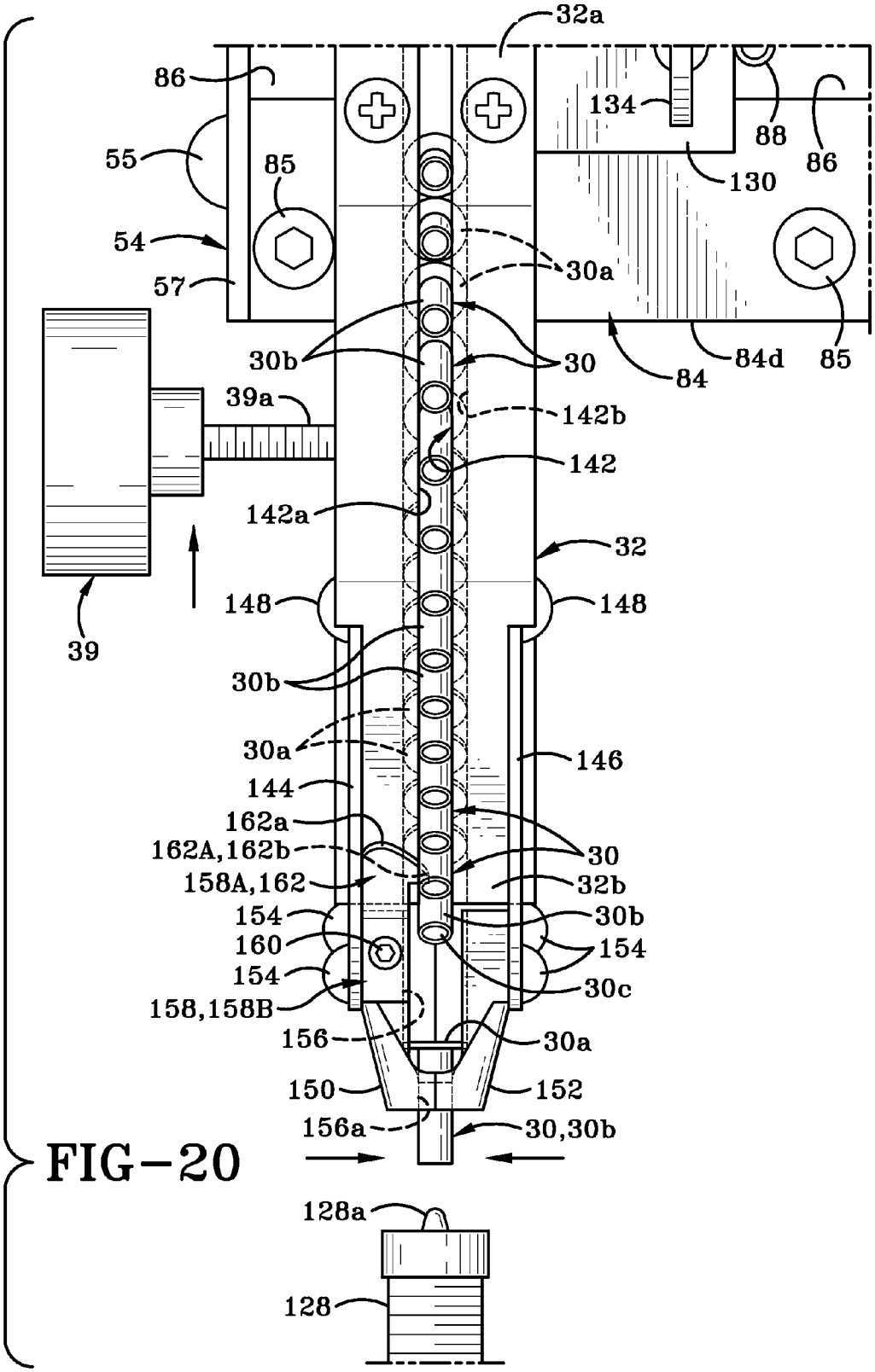
FIG. 20 is a front view of the feed assembly showing the feed chute with the next rivet positioned and ready for riveting.

Rivets fed into the opening in upper edge 136*a* of feed chute 136 drop through first section 28*a* into the rotating second section 28*b* and subsequently are fed one at a time through an opening (not shown) in tumbler 28 and into a feedslot 142 (FIG. 12) defined in raceway 32. Although it is not obvious from the figures, feedslot 142 is generally T-shaped in cross-section and includes a narrower region 142*a* and a wider region 142*b*. Rivets 30 are shown in FIG. 14 stacked one above the other within feedslot 142. As is evident from FIGS. 14 and 17, each rivet has a head 30*a* and a shaft 30*b*. Heads 30*a* are captured within the wider region 142*b* of feedslot 142 and the tubular shafts 30*b* extend outwardly through the narrower region 142*a* of feedslot 142. Rivets 30 slide downwardly through feedslot 142 until the lowermost rivet 30 enters a bottom region 32*b* (FIG. 5) of raceway 32. When a plurality of rivets 30 are engaged in feedslot 142, heads 30*a* thereof will butt up against one another in feedslot 142 as illustrated in FIG. 17. This arrangement causes the rivets to be generally equally spaced from each other along feedslot 142. Heads 30*a* progressively slide down feedslot 142 as each lowermost rivet is engaged by plunger 36 with workpieces 38, 40 positioned adjacent spreader 128*a*.

Figure 7:
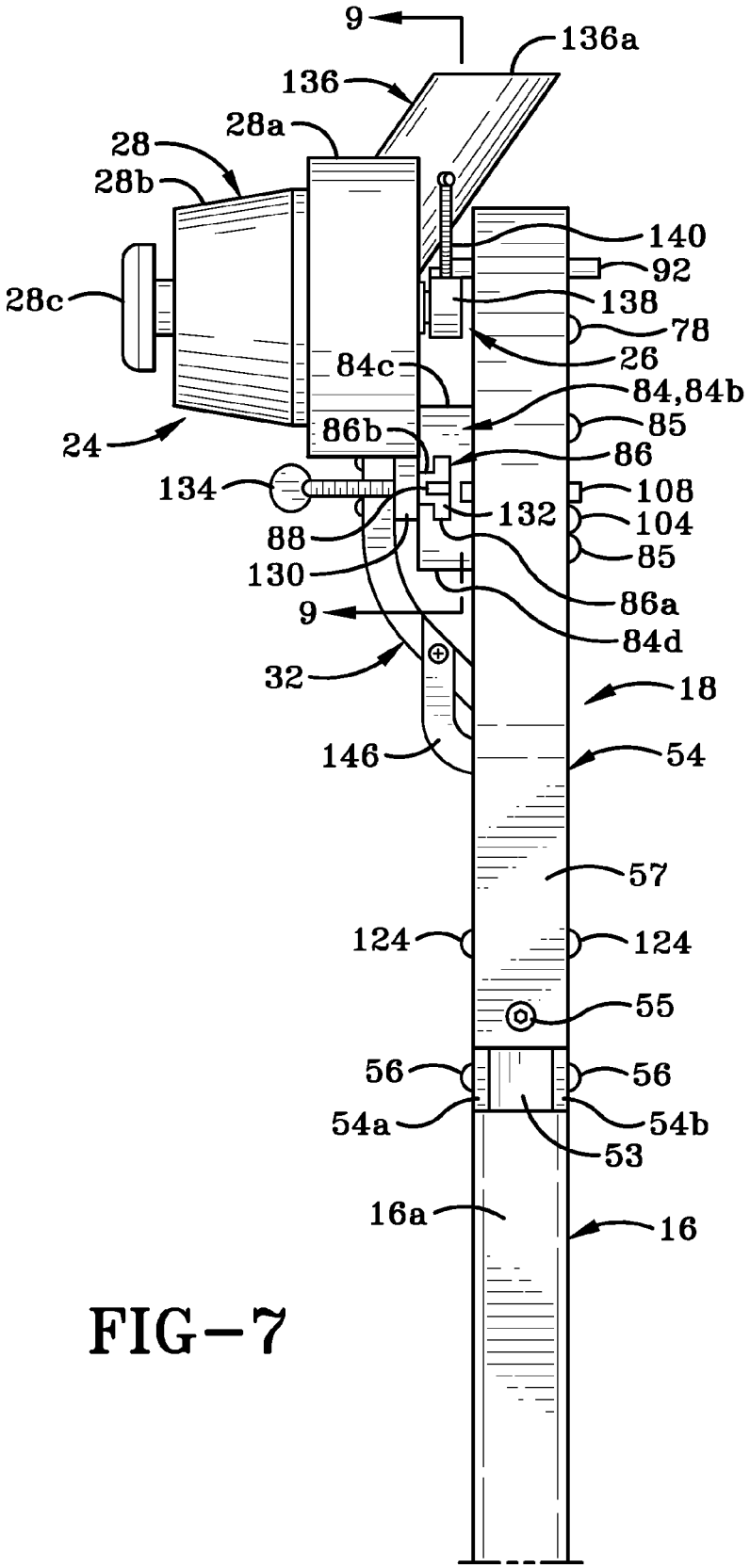
FIG. 7 is a rear elevational view of the head of the riveter.
Figure 12:
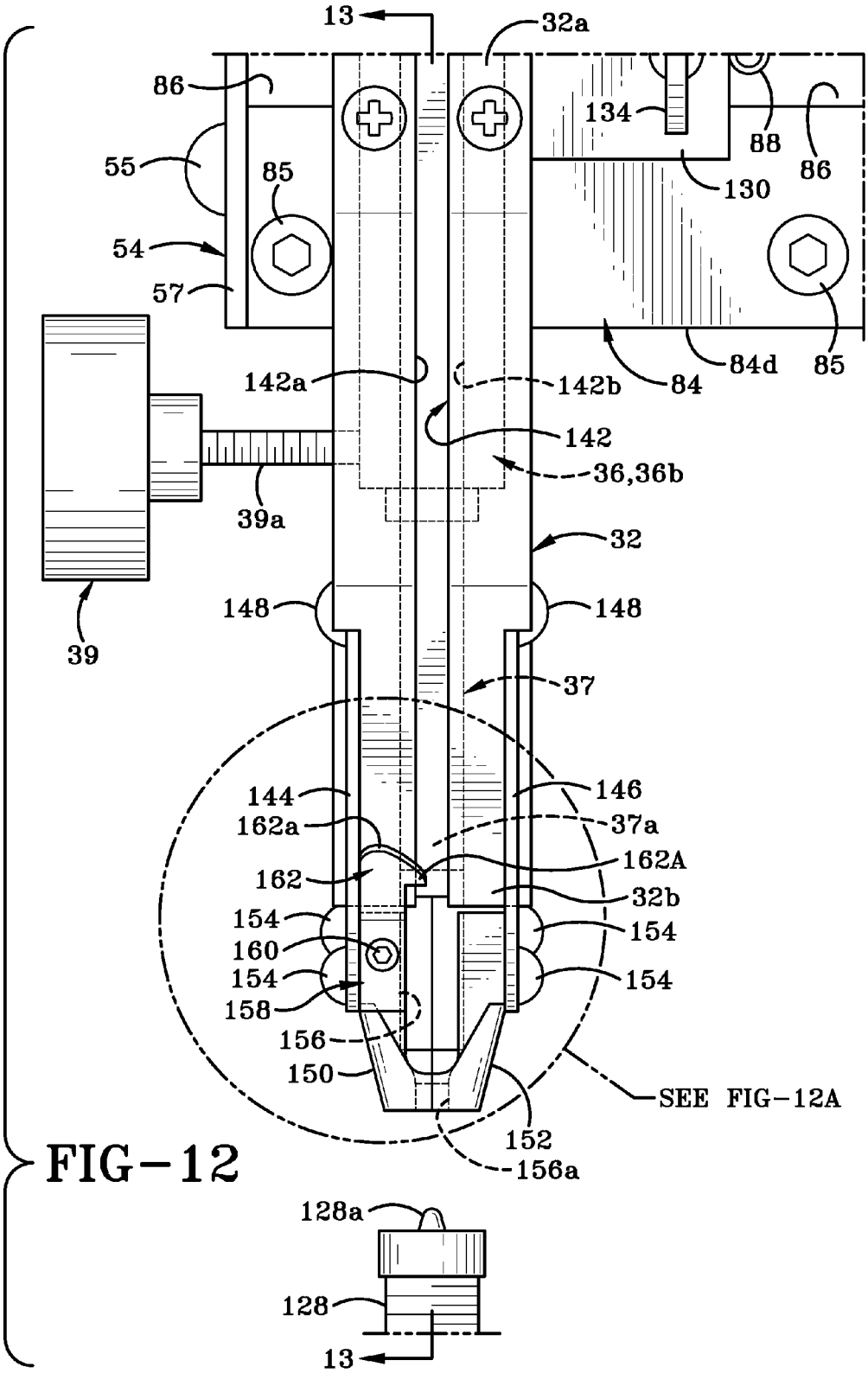
FIG. 12 is an enlarged front elevational view of the feed assembly of the riveter.
Figure 12A:
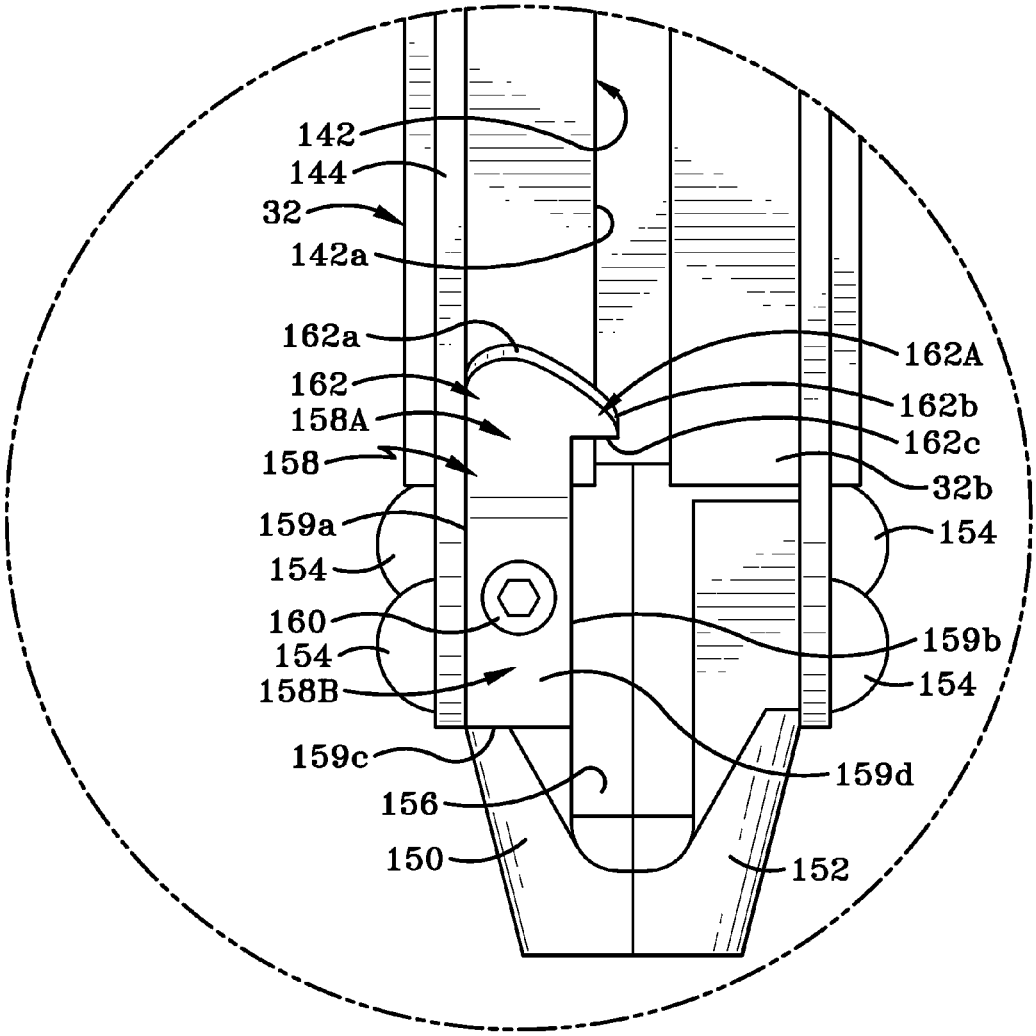
FIG. 12A is an enlargement of the highlighted region of FIG. 12.

Referring to FIGS. 5, 7 and 12, a pair of spring arms 144, 146 are secured by fasteners 148 to a front and back region, respectively, of raceway 32. A lower end of each spring arm 144, 146 is respectively secured to a tapered guide block 150, 152 by way of additional fasteners 154. FIG. 13 shows that guide blocks 150, 152 define between them a tapered channel 156. Channel 156 is configured to permit a rivet 30 to drop into the same and caused to be oriented with the shaft 30*b* thereof extending vertically downwardly and projecting out of the bottom end 156*a* of channel 156. When a rivet 30 is so positioned, the opening to the bore defined in rivet 30 will be disposed in alignment with a spreader 128*a* extending upwardly from spreader screw 128. This is illustrated in FIG. 14. When the movement of first region 132 and thereby feed assembly 24 is halted by assembly stop 88, plunger 36 will be positioned so as to pass through channel 156 between guide blocks 150, 152 on the feed assembly 24 and will be correctly aligned with spreader 128*a* on spreader screw 128.

A rivet stop 158 is secured to one or the other of spring arms 144, 146 and may particularly be secured to one or the other of guide blocks 150, 152 provided on spring arms 144, 146. FIGS. 12-13A and 16 show rivet stop 158 secured to guide block 150 by way of a fastener 160. Rivet stop 158 is a generally J-shaped member that includes a shaft 159 and a hook 162. Shaft 159 has straight side edges 159*a*, 159*b* and bottom edge 159*c*. First side edge and second side edge 159*a*, 159*b* are substantially parallel to each other and are spaced from each other. Bottom edge 159*c* extends between side edges 159*a*, 159*b* and is oriented at right angled thereto. Shaft 159 also has a exterior surface 159*d* and an interior surface 159*e*.

Hook 162 includes a projection 162A and has a curved upper edge 162*a* and a generally V-shaped tip 162*b*. Tip 162*b* extends for a distance outwardly beyond second side edge 159*b* of shaft 159. Tip 162*b* also includes a shoulder edge 162*c* disposed generally at right angles to second side edge 159*b*. Curved outer edge of head 162 intersects the shoulder edge at an acute angle. The acute angle is approximately 45 degrees.

As best seen in FIG. 13, shaft 159 of rivet stop 158 also includes a first section 158A and a second section 158B. First and second sections 158A, 158B are disposed at an angle $\alpha$ to each other and that angle $\alpha$ is from about 133 degrees up to about 137 degrees. A suitable angle between first and second sections 148A, 158B is approximately 135 degrees. First section 158A comprises head 162 and an upper region of shaft 159. Second section 158B is comprised of the rest of the length of shaft 159 and may include the majority of the length of shaft 159. Second section 158B is substantially vertically oriented and is secured to a substantially vertical side wall of guide block 150. First section 158A extends upwardly and outwardly beyond an upper wall of guide block 150 and is oriented substantially parallel to a bottom end 32*b* of raceway 32. First section 158A is positioned alongside a lowermost region of feedslot 142 and in such a manner that tip 162*b* extends partially across the width of feedslot 142, as is shown in FIG. 12.

Figure 15:
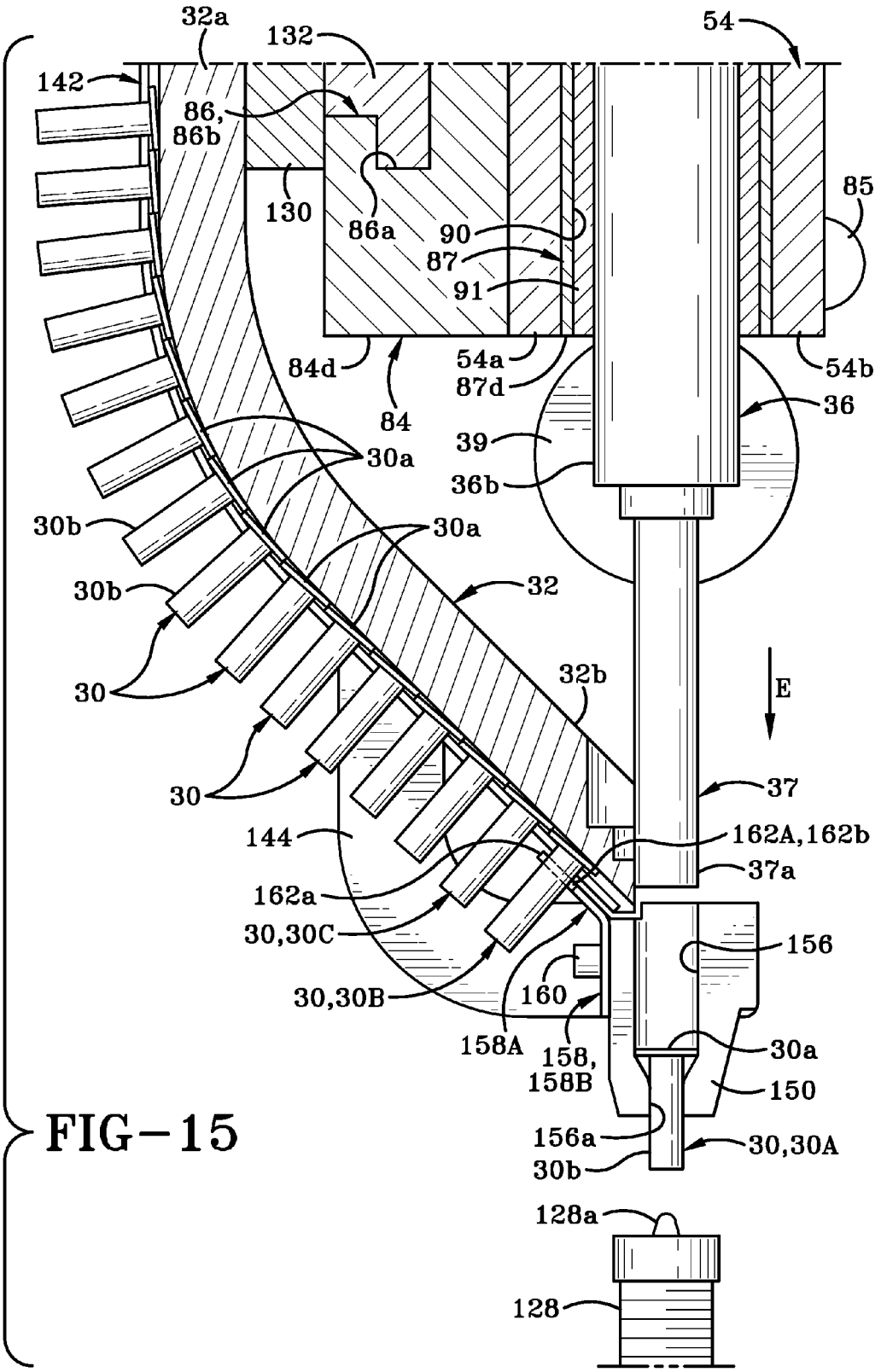
FIG. 15 is a right side cross-sectional view of the feed assembly taken along line 15-15 of FIG. 14.
Figure 16:
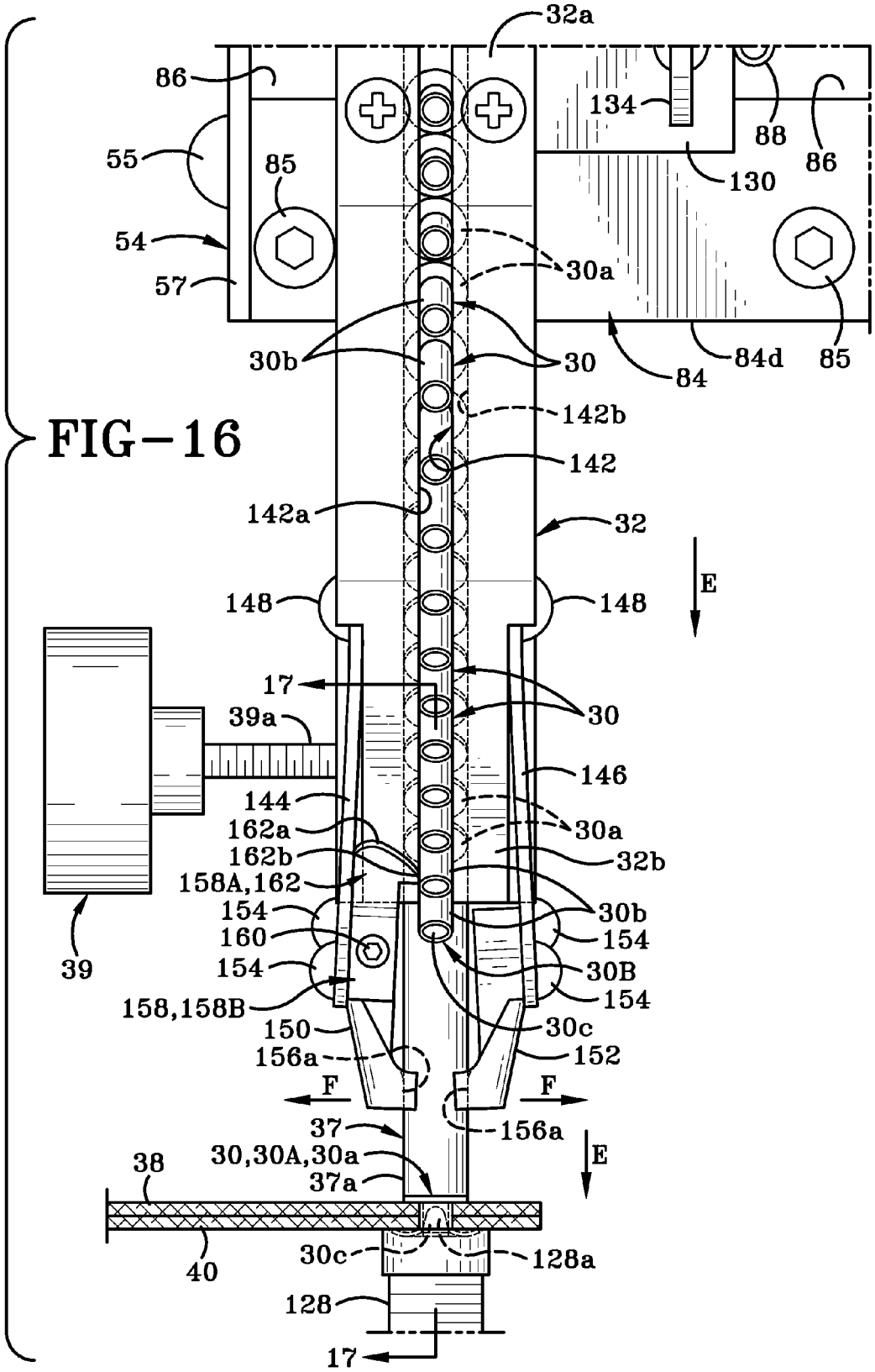
FIG. 16 is an enlarged front elevational view of the feed assembly with the plunger moved to a riveting position.

Rivet stop 158 is positioned so that when rivets 30 are received in raceway 32 and spring arms 144, 146 are in an at-rest position (FIG. 14), tip 162*b* of head 162 of rivet stop 158 will extend between a shaft 30*b* of a lowermost rivet 30A (FIG. 15) and a shaft 30*b* of a second from lowermost rivet 30B. Tip 162*b* therefore separates rivet 30B from rivet 30A and substantially prevents rivet 30B and therefore the other rivets in feedslot 142 from sliding vertically downwardly in feedslot 142. This enables the riveter 10 to be used to install rivet 30A without rivet 30B accidentally sliding down raceway 32 and blocking the downward movement of tip 37. During installation of rivet 30*a*, tip 37 of plunger 36 moves through channel 156 and thereby causes spring arms 144, 146 to move from an at-rest position (FIG. 14) to an operational position (FIG. 16). As this occurs, tip 37 moves guide blocks 150 and 152 laterally apart from each other, thereby moving spring arms 144, 146 laterally apart from each other. Since rivet stop 158 is mounted on guide block 150 or spring arm 144, rivet stop 158 is also caused to move laterally and outwardly away from guide block 150. This lateral movement shifts tip 162 into a position where it no longer extends across feedslot 142 and therefore no longer can prevent shaft 30*b* of rivet 30B from being pulled downwardly by gravity. Consequently, rivet 30B can start to move vertically downwardly and into channel 156 as plunger 37 withdraws therefrom. Rivet 30C thus is able to slide downwardly along feedslot 142 into the position previously occupied by rivet 30B. As plunger tip 37 withdraws from channel 156, rivet 30B drops into the position previously occupied by rivet 30A and guide blocks 150, 152 move laterally inwardly toward each other. The lateral inward movement is thus also imparted to spring arms 144, 146 and to rivet stop 158. The tip 162 of rivet stop 158 moves between the shaft 30*b* of rivet 30B and the shaft 30*b* of rivet 30C. Installation of rivet 30B will allow rivet 30C to slide down feedslot 142 and into channel 156 as previously described.

It will thus be understood that the configuration of the components at the lower end of raceway 32, and particularly the configuration and placement of rivet stop 158, enables riveter 10 to be automatically reloaded with rivets. This reloading may occur without the operator having to stop working and physically depress a button or make some other movement to cause a new rivet to be positioned for installation. Additionally, the movement of plunger 36 not only automatically reloads a rivet, such as rivet 30B, into the channel 156 between guide blocks 150, 152, the plunger 36 also causes rotation of tumbler 28 via lever assembly 26. The rotation of tumbler 28 in turn causes a new rivet to drop out of tumbler 28 and into the upper end 32*a* of raceway 32. Thus, the operator will only have to address the loading or reloading of rivets 30 when all the rivets rotating within tumbler 28 have been moved into raceway 32 and are beginning to be used up.

Foot operated rivet riveter 10 is used in the following manner. The operator positions two workpieces 38, 40 to be secured together above spreader screw 28 on platform 34. The operator depresses foot pedal 20, moving pedal 20 downwardly in the direction of arrow "D" (FIG. 1). This motion causes first linkage arm 22*a* and second linkage arm 20*b* to pivot relative to each other. The rotation of second linkage arm 20*b* drives plunger 36 downwardly in the direction of arrow "E" (FIGS. 15 and 16). Bottom end 37*a* of tip 37 is caused to move into channel 156 between guide blocks 150, 152 causing them and the spring arms 144, 146 engaged therewith to move apart from each other in the direction of arrow "F" (FIG. 16). As tip 37 continues to be moved downwardly by plunger 36, a bottom end 37*a* thereof contacts the head 30*a* of rivet 30A. Rivet 30A is captured in channel 156 of guide blocks 150, 152. As plunger 36 continues to move downwardly rivet 30A is driven downwardly until its lowermost end contacts the upper workpiece 38. Continued downward motion of rivet 30A causes rivet 30A to be punched through upper workpiece 38 and lower workpiece 40 and ultimately spreader 128*a* of spreader screw 28 enters the bore 30*c* (FIG. 17) of rivet 30A. The contact between shaft 30*b* of rivet 30A and spreader 28 causes shaft 30*b* to radially split, spreading out for a distance along the underside of lower workpiece 40, thereby joining upper and lower workpieces 38, 40 together.

Additionally, because spring arms 144, 146 have separated from each other because of the movement of plunger tip 37 therethrough, rivet stop 158 is moved out its arresting position shown in FIG. 14 to its inactive position shown in FIG. 16. Thus, the next rivet in the raceway 32, namely rivet 30B, is no longer prevented from sliding down feedslot 142. When the operator lifts his or her foot off foot pedal 20, pedal 20 moves in the opposite direction to arrow "D". This cause first and second linkage arms 22*a*, 22*b* to pivot in the opposite direction, thereby raising plunger 36 in the opposite direction to arrow "E". As earlier described herein, the upward movement of plunger 36 results in the rotation of second section 28*b* of tumbler 28, and a new rivet (not shown) drops from tumbler 28 into raceway 32. When tip 37*a* moves past rivet 30B, gravity takes rivet 30B and it drops into channel 156. By this point, spring arms 144, 146 are returning to their at-rest position (FIG. 14). This causes upper edge 162*a* of rivet stop 158 to contact the head 30*a* of the next rivet 30C (FIG. 15), preventing the same from sliding into channel 156. The operator will then position then next workpieces to be joined above spreader 28 and repeat the aforementioned process.

If it is decided to change the type of component that is to be used to fasten workpieces together, feed assembly 24 is removed by simply rotating the thumbscrew 134 in the appropriate direction to release pressure on first region 132. Feed assembly 24 is then separated from riveter 10 as indicated by the arrow in FIG. 21.

Figure 22:
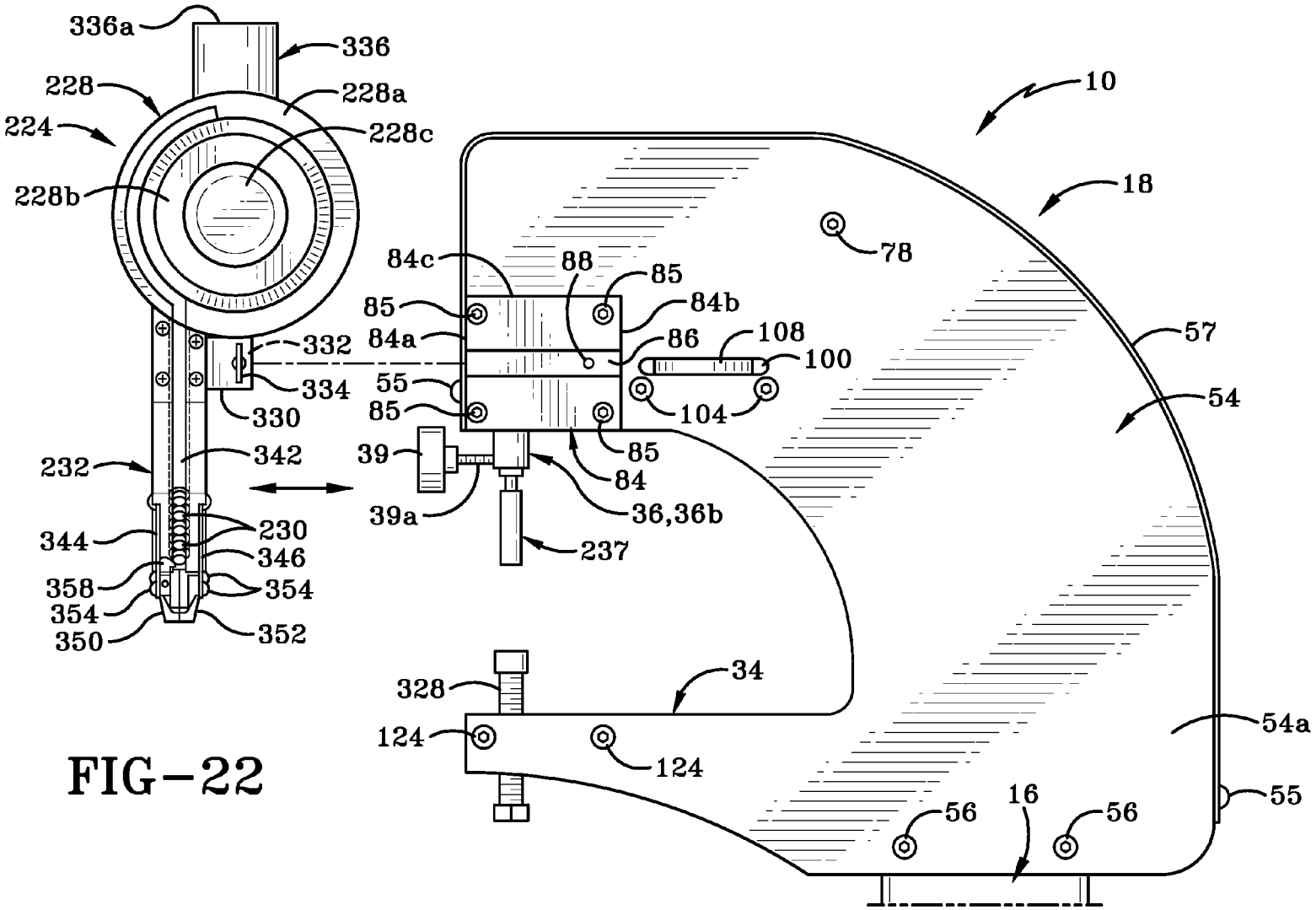
FIG. 22 is a right side view of the head of the riveter; showing a second feed assembly loaded with a second type of fastener for securing workpieces together.

A second feed assembly 224 (FIG. 22), which is configured to provide second fastener components 230 which differ from rivets 30, is then slid into slot 86 of mounting block 84 in order to engage assembly 224 with riveter 10. (Second fastener components 230 may differ from rivets 30 in any of a variety of ways. By way of example only, FIG. 22 shows second fasteners 230 that have larger shaft diameters than the rivets 30.) Second feed assembly 224 includes a tumbler 228 (including fixed and rotating regions 228*a*, 228*b* and a securement member 228*c*), a feed chute 336 having an opening (not shown) defined in end 336*a*; and a raceway 232. Raceway 232 has a first end 232*a* which is in communication with the interior of tumbler 228. Spring arms 344, 346 are secured to raceway 232 and guide blocks 350, 352 extend downwardly from spring arms 344, 346. Second fasteners 230 are placed into the opening in end 336*a* of feed chute 336, drop into tumbler 228 and are fed, one-at-a-time, from fixed region 228*a* of tumbler 228 into rotating region 228*b* thereof. The fasteners 230 then move one-at-a-time into feedslot 342. As with feed assembly 24, second feed assembly 224 is provided with the components necessary to interlockingly dovetail with the cross-section shape of slot 86. Consequently, second feed assembly 224 includes a connector comprising a mounting block 330 which has a first region 332 that is of a complementary configuration to the T-shaped slot 86 defined in block 84 of riveter 10. A locking member 334 is also provided on connector to lock second feed assembly 224 to riveter 10.

In order to use second feed assembly 224, it may be necessary to change the tip 37 of plunger 36 so that it is suitably configured to install the second fasteners 230. The operator will release rotate handle 39 in the second direction, pull tip 37 out of a recess (not shown) in the second end 36*b* of plunger 36 and will replace it with a new tip 237 that is configured to suitable engage and secure second fasteners 230. Once tip 237 is inserted into the recess in plunger 36, handle 39 is rotated in the first direction to lock tip 237 to plunger 237. Similarly, it may be necessary to also replace spreader screw 128 with a differently configured spreader screw 328 so that second fasteners 230 may be installed in the workpieces to be joined. In order to replace spreader screw 128, the bolt at the lower end of spreader screw 128 is disengaged and the spreader screw 128 is threadably disengaged from the through-hole 126 (FIG. 8). The replacement spreader screw 328 is then threadably inserted into the through-hole and a bolt is engaged with the lower end of spreader screw 328.

Second feed assembly 224 is engaged with riveter 10 in the exact same manner as is feed assembly 24. Thus, the first region 332 of the connector on second feed assembly 224 is introduced into the opening to slot 86 in first face 84*a* of block 84. Second feed assembly 224 will be moved along slot 86 until the connector engages stop 88. At this point assembly, second feed assembly 224 is in the operational position. Locking member 334 of the connector is then moved from an unlocked position to a locked position by rotating the locking member 334 in the appropriate direction. The tip 237 of plunger 36 will extend through a channel (not numbered but similar to channel 156) in guide blocks 250, 252 of the second feed assembly 224 in the same manner as feed assembly 24 is engaged by tip 37 of plunger 36. Plunger 36 is used in the same manner as plunger 36 to drive a lowermost one of the second fasteners 230 into two or more workpieces in order to join the workpieces to each other.

Second feed assembly 224 is also provided with a rivet stop 358 that is substantially identical in structure and function to rivet stop 58.

Thus, riveter 10 may be set up to use one or the other of feed assemblies 24 or 224 depending on which of the fasteners 30 or second fasteners 230 are required for joining workpieces, such as 38 and 40, together. In each instance, because of the enclosed linkage assembly 22 in post 16, the riveter 10 may be positioned directly adjacent vertical structures such as walls without interfering with the functioning of the riveter 10. Furthermore, the provision of rivet stops 158, 358 on the respective feed assemblies 24, 224 ensures automatic feeding of fasteners 30 or 230 during use of the riveter 10.

Riveter 10 is used to secure two separate workpieces 38, 40 together by the method of:

- providing a first feed assembly 24 which holds and delivers a type of first fastener 30 for securement of workpieces 38, 40;
- engaging first assembly 24 with riveter 10; and
- operating riveter 10 to drive one or more of first fasteners 30 into workpieces 38, 40 to secure the workpieces together.

The method may also comprise:

- providing a second feed assembly 224 which holds and delivers a type of second fastener 230 for securement of workpieces 38, 40;
- selecting one of the types of first or second fasteners 30 or 230 to secure two workpieces 38, 40 together;
- selecting the associated one of first and second feed assemblies 24 or 224;
- engaging the selected one of first and second feed assemblies 24 or 224 with riveter 10; and
- operating riveter 10 to drive one or more of the selected first or second fasteners 30 or 230 into workpieces 38, 40 to secure the workpieces together.

The step of engaging the selected one of first and second feed assemblies 24 or 224 with riveter 10 includes:

- inserting a first region 132 or 332 of a connector on the selected one of first and second feed assemblies 24 or 224 into a slot 86 on a head 18 of riveter 10;
- moving first region 132 of the connector along slot 86 in a first direction.

The step of engaging further includes:

- contacting an assembly stop 88 on head 18 of riveter 10 with a first end of first region 132 or 332 of the connector; and
- engaging a locking member 134 or 334 to prevent further motion of first region 132 or 332 of the connector along slot 86.

The step of engaging locking member 134 or 334 includes:

- rotating locking member 134 or 334 in a first direction;
- applying pressure on first region 132 or 332 of the connector; and
- urging first region 132 or 332 of the connector into frictional engagement with a wall of riveter 10 which defines slot 86 within which first region 132 or 332 of the connector is received.

The method may further comprise:

- depressing foot pedal 20 in a first direction "D" (FIG. 1);
- moving plunger 36 downwardly to drive a lowermost of the selected one of first and second fasteners 30 or 230 disposed in the selected one of first and second feed assemblies 24 or 224 through workpieces 38, 40;
- joining workpieces 38, 40 together;
- releasing foot pedal 20 so that foot pedal 20 moves in a second direction (opposite to direction "D");
- moving plunger 36 upwardly away from workpieces 38, 40; and
- removing joined workpieces 38, 40 from riveter 10.

The method may further comprise:

- sliding a plurality of the selected one of first and second fasteners 30 or 230 along a feedslot 142, 342 in the selected one of first and second feed assemblies 24 or 224;
- positioning the lowermost of the plurality of the selected ones of the first and second fasteners, such as rivet 30A, in a position to be engaged by plunger 36 when plunger 36 moves downwardly (in the direction "E"—FIG. 15).

The method may further comprise:

- positioning workpieces 38, 40 to be joined above a spreader 128 or 328 on riveter 10;
- depressing foot pedal 20 to move plunger 36 downwardly toward spreader 128 or 328;

contacting the lowermost of the plurality of the selected ones of the first and second fasteners, such as rivet 30A, with a tip 37 or 237 of the plunger;

driving the lowermost of the plurality of the selected ones of the first and second fasteners, such as rivet 30A, downwardly and into workpieces 38, 40 to be jointed;

spreading a shaft 30*b* of the lowermost of the plurality of the selected ones of first and second fasteners, such as 30A, using spreader 128 or 328.

The method may further comprise:

selecting new workpieces to be joined together above spreader 128 or 328.

The method may further comprise:

selecting the other of first and second fasteners 30 or 230 to join the new workpieces together;

changing a tip 37 or 237 of plunger 36 to be complementary to the selected other of first and second fasteners 30 or 230; and changing spreader 128 or 328 to be complementary to the selected other of first and second fasteners 30 or 230.

The method may further comprise:

rotating locking member 134 or 334 in a second direction;

releasing pressure on first region 132 or 332 of the connector;

moving first region 132 or 332 of the connector along slot 86 in a second direction until first region 132 or 332 of the connector moves out of an opening to the slot 86; and engaging the other of first and second feed assemblies 24 or 224 with riveter 10.

The method may further comprise:

inserting a first region 132 or 332 of a connector on the selected other of first and second feed assemblies 24 or 224 into the opening to slot 86;

moving first region 132 or 332 of the connector of the selected other of first and second feed assemblies 24 or 224 along slot 86 in the first direction;

contacting assembly stop 88 with first region 132 or 332 of the connector of the selected other of the first and second feed assemblies 24 or 224 to halt further movement thereof in the first direction; and engaging a locking member 134 or 334 on the selected other of first and second feed assemblies 24 or 224 to lock the selected other of the first and second feed assemblies to riveter 10.

The method may further comprise:

depressing foot pedal 20 of riveter 10 in a first direction "D" (FIG. 1);

moving plunger 36 downwardly to drive one of the selected other of first and second fasteners 30 or 230 disposed in the selected other one of first and second feed assemblies 24 or 224 through new workpieces 38, 40 to be joined;

joining new workpieces 38, 40 together;

releasing foot pedal 20 so that the foot pedal moves in a second direction;

moving plunger 36 upwardly away from the joined new workpieces 38, 40; and removing the joined new workpieces 38, 40 from riveter 10.

In accordance with another aspect, the invention may provide a method of using a riveter 10 to secure two separate workpieces 38, 40 together; said method comprising:

providing a feed assembly 24 on riveter 10 which holds and delivers plurality of fasteners 30 for securement of workpieces 38, 40;

providing a rivet stop 158 on feed assembly 24 to control the feed of fasteners 30 through a raceway 32 of feed assembly 24; and operating riveter 10 to drive a lowermost one of fasteners 30A in raceway 32 into workpieces 38, 40 to secure the workpieces together.

The method may further comprise:

inserting a rivet stop 158 between the lowermost of the plurality of fasteners 30A and the second from lowermost of the plurality of fasteners 30B.

The method may further comprise:

inserting a tip 162*b* of rivet stop 158 between the lowermost of the plurality of fasteners 30A and the second from lowermost of the plurality of fasteners 30B;

The method may further comprise:

flexing spring arms 144, 146 of feed assembly 24 away from each other (in the direction of arrows "F"—FIG. 16);

breaking contact between rivet stop 158 and the second from lowermost plurality of fasteners 30B.

The method may further comprise:

inserting a tip 37 of plunger 36 into a channel 156 between guide blocks 150, 152 on spring arms 144, 146;

contacting head 30*a* of the lowermost fastener 30A with tip 37 of plunger 36;

moving plunger 36 downwardly;

driving a shaft 30*b* of lowermost fastener 30A into two workpieces 38, 40; and joining two workpieces 38, 40 together.

The method may further comprise:

moving plunger 36 upwardly;

moving the second from lowermost fasteners 30B into channel 156 between guide blocks 150, 152;

moving spring arms 144, 146 toward each other;

bringing a curved outermost edge 162*a* of rivet stop 158 into contact with a shaft 30*b* of a third from lowermost fastener 30C; and halting movement of the third from lowermost fasteners 30C down raceway 32.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of an embodiment of the invention is by way of example only and the invention is not limited to the exact details shown or described.

The invention claimed is:

1. A feed assembly for a riveter comprising:

a tumbler defining a cavity therein;

a raceway extending downwardly from the tumbler; wherein said raceway defines a feedslot therein; and wherein the feedslot which is adapted to receive fasteners one at a time from the tumbler;

a pair of opposed resilient spring arms; wherein a first end of each of the spring arms is fixedly secured to the raceway remote from the tumbler;

a guide block provided on a second end of each spring arm;

a channel defined between the guide blocks, the channel being adapted to receive a lowermost fastener from the raceway therein; wherein the channel is adapted to selectively receive a plunger from the riveter therethrough and when the plunger passes through the channel the guide blocks move laterally away from each other and the second ends of the spring arms flex outwardly away from each other; wherein the plunger contacts the lowermost fastener and moves the lowermost fastener through the channel and out of the raceway; and a rivet stop provided on one of the spring arms or on one of the guide blocks; wherein a section of said rivet stop projects across the feedslot of the raceway and is adapted to selectively contact a second from lowermost fastener and prevent movement of the second from lowermost fastener along the feedslot and into the channel.

2. The feed assembly as defined in claim 1, wherein the spring arms are spaced a first distance from each other adjacent the rivet stop when the plunger extends through the channel; and the spring arms are spaced a second distance from each other adjacent the rivet stop when the plunger does not extend through the channel; and the first distance is greater than the second distance.

3. The feed assembly as defined in claim 2, wherein the rivet stop is located on the raceway between the tumbler and the guide blocks; and the rivet stop is adapted to prevent downward movement of the second from lowermost fastener when the spring arms are spaced the second distance from each other; and the rivet stop does not prevent downward movement of the second from lowermost fastener when the spring arms are spaced the first distance from each other.

4. The feed assembly as defined in claim 3, wherein the rivet stop is substantially J-shaped.

5. The feed assembly as defined in claim 4, wherein the J-shaped rivet stop includes a shaft and a head, and the head has a curved outermost edge, and the outermost edge is adapted to contact a head of the second from lowermost fastener when the spring arms are disposed the second distance from each other.

6. The feed assembly as defined in claim 5, wherein the head of the rivet stop further includes a V-shaped tip adapted to be positioned between the lowermost fastener and the second from lowermost fastener when the spring arms are disposed the second distance from each other.

7. The feed assembly as defined in claim 6, wherein the shaft includes a first side edge and a second side edge, and the tip of the head extends for a distance outwardly beyond the second side edge of the shaft.

8. The feed assembly as defined in claim 7, wherein the tip includes a shoulder edge disposed generally at right angles to the second side edge of the shaft.

9. The feed assembly as defined in claim 8, wherein the curved outer edge of the head intersects the shoulder edge at an acute angle.

10. The feed assembly as defined in claim 9, wherein the acute angle is approximately 45 degrees.

11. The feed assembly as defined in claim 10, wherein the shaft of the rivet stop includes a first section that is substantially vertically disposed, and a second section extending outwardly from one end of the first section at an angle; and the head of the rivet stop extends outwardly from an end of the second section remote from the first section.

12. The feed assembly as defined in claim 11, wherein the angle is from about 133 degrees up to about 137 degrees relative to the first section.

13. The feed assembly as defined in claim 12, wherein the head is coplanar with the second section.

14. The feed assembly as defined in claim 1, further comprising:

a feed chute defining an opening therein that is in communication with the cavity of the tumbler; wherein the feed chute is adapted to feed a plurality of fasteners through the opening and into the cavity of the tumbler.

15. A riveter comprising:

a base adapted to rest on a floor surface;

a post extending upwardly from the base and defining a cavity therein;

a head defining a cavity therein; wherein the head of the riveter is mounted on the post a distance from the base;

a foot pedal extending outwardly and forwardly from the post;

a plunger mounted for reciprocal movement within the head; and a linkage assembly engaged with the foot pedal and the plunger; wherein a portion of the linkage assembly is retained within the cavity of the post; and another portion of the linkage assembly is retained within the cavity of the head; wherein lever arms of the linkage assembly pivot entirely within the cavities of the post and head of the riveter; and wherein movement of the foot pedal in a first direction causes the linkage assembly to move the plunger within the head in a first manner; and movement of the foot pedal in a second direction causes the linkage assembly to move the plunger within the head in a second manner; and a feed assembly, wherein the feed assembly comprises:

a tumbler defining a cavity therein;

a raceway extending downwardly from the tumbler; wherein said raceway defines a feedslot therein; and wherein the feedslot is adapted to receive fasteners one at a time from the tumbler;

a pair of opposed spring arms; wherein a first end of each of the spring arms is fixedly secured to the raceway remote from the tumbler;

a guide block provided on a second end of each spring arm;

a channel defined between the guide blocks, the channel being adapted to receive a lowermost fastener from the raceway therein;

the plunger selectively passes through the channel and moves the guide blocks laterally away from each other and the second ends of the spring arms flex outwardly away from each other; and wherein the plunger is adapted to contact the lowermost fastener and move the lowermost fastener through the channel and out of the raceway; and a rivet stop provided on one of the spring arms or one of the guide blocks; wherein a section of said rivet stop projects across the feedslot of the raceway and is adapted to selectively contact a second from lowermost fastener and prevent movement of the second from lowermost fastener along the feedslot and into the channel.

16. The riveter as defined in claim 15, wherein the rivet stop is substantially J-shaped.

17. The riveter as defined in claim 16, wherein the J-shaped rivet stop includes a shaft and a head, and the head has a curved outermost edge, and the outermost edge is adapted to contact a head of the second from lowermost fastener when the spring arms are disposed the second distance from each other.

18. The riveter as defined in claim 17, wherein the head of the rivet stop further includes a V-shaped tip adapted to be positioned between the lowermost fastener and the second from lowermost fastener when the spring arms are disposed the second distance from each other.

19. The riveter as defined in claim 18, wherein the shaft includes a first side edge and a second side edge, and the tip of the head extends for a distance outwardly beyond the second side edge of the shaft.

20. The riveter as defined in claim 19, wherein the tip includes a shoulder edge disposed generally at right angles to the second side edge of the shaft.

21. The riveter as defined in claim 20, wherein the curved outer edge of the head intersects the shoulder edge at an acute angle.

22. The riveter as defined in claim 21, wherein the acute angle is approximately 45 degrees.

23. The riveter as defined in claim 22, wherein the shaft of the rivet stop includes a first section that is substantially vertically disposed, and a second section extending outwardly from one end of the first section at an angle; and the head of the rivet stop extends outwardly from an end of the second section remote from the first section.

24. The riveter as defined in claim 23, wherein the angle is from about 133 degrees up to about 137 degrees relative to the first section.

25. The combination as defined in claim 24, wherein the head is coplanar with the second section.

26. The riveter as defined in claim 15, wherein the feed assembly is selectively detachably engaged with the head of the riveter.

27. The riveter as defined in claim 15, further comprising a second feed assembly second that is selectively detachably engaged with the head of the riveter when the feed assembly is disengaged from the head; and wherein the feed assembly carries a plurality of first fasteners and the second feed assembly carries a plurality of second fasteners that differ from the first fasteners.

28. The riveter as defined in claim 15, wherein the first ends of the spring arms and the second ends of the spring arms are spaced a first distance laterally apart from each other when the riveter is non-operational; wherein when the plunger passes through the channel the first ends of the spring arms remain a first distance apart and the second ends of the spring arms flex outwardly away from each other to where the second ends are spaced a second distance apart from each other, and wherein the second distance is greater than the first distance.

* * * * *